US007413360B2

(12) United States Patent
Kikuchi

(10) Patent No.: US 7,413,360 B2
(45) Date of Patent: Aug. 19, 2008

(54) SHEET CUTTING APPARATUS, SHEET AFTERTREATMENT APPARATUS HAVING THE SAME, AND IMAGE FORMING APPARATUS HAVING THE SAME

(75) Inventor: Toshiki Kikuchi, Kashiwa (JP)

(73) Assignee: Canon Finetech Inc., Ibaraki-Ken (JP)

( * ) Notice: Subject to any disclaimer, the term of this patent is extended or adjusted under 35 U.S.C. 154(b) by 556 days.

(21) Appl. No.: 11/083,933

(22) Filed: Mar. 21, 2005

(65) Prior Publication Data

US 2005/0211042 A1 Sep. 29, 2005

(30) Foreign Application Priority Data

Mar. 24, 2004 (JP) ..... 2004-088005

(51) Int. Cl.
*B41J 11/70* (2006.01)
*G03G 15/00* (2006.01)

(52) U.S. Cl. ..... 400/621; 83/613; 399/407

(58) Field of Classification Search ..... None
See application file for complete search history.

(56) References Cited

U.S. PATENT DOCUMENTS

| | | | | |
|---|---|---|---|---|
| 6,012,367 | A * | 1/2000 | Westra et al. | 83/147 |
| 6,302,007 | B1 * | 10/2001 | Tobler | 83/36 |
| 6,601,490 | B1 * | 8/2003 | Gross et al. | 83/27 |
| 7,014,182 | B2 * | 3/2006 | Marsh | 270/58.07 |
| 2005/0061135 | A1 * | 3/2005 | Yamaguchi et al. | 83/869 |

FOREIGN PATENT DOCUMENTS

| | | | |
|---|---|---|---|
| DE | 4442916 | A1 * | 6/1996 |
| JP | 2003071780 | A * | 3/2003 |
| JP | 2003-292230 | | 10/2003 |

* cited by examiner

*Primary Examiner*—Daniel J Colilla
(74) *Attorney, Agent, or Firm*—Fitzpatrick, Cella, Harper & Scinto

(57) ABSTRACT

A sheet cutting apparatus including: a cutting blade for cutting a sheet to be cut, which includes a sheet or a sheet stack; and a transport devices capable of holding and rotating the sheet to be cut to cause an end portion of the sheet to be cut to be opposed to the cutting blade and transporting the sheet to be cut to a position where the end portion is cut by the cutting blade.

5 Claims, 15 Drawing Sheets

SHEET CUTTING APPARATUS, SHEET AFTERTREATMENT APPARATUS HAVING THE SAME, AND IMAGE FORMING APPARATUS HAVING THE SAME

This application claims priority benefits of Japanese Patent Application No. 2004-088005 filed Mar. 24, 2004, the entire disclosure of which is hereby incorporated herein by reference in its entirety.

BACKGROUND OF THE INVENTION

1. Field of the Invention

The present invention relates to a sheet cutting apparatus in which a portion of a cutting blade to be used for cutting a sheet, a sheet stack, etc. is varied to make it possible to uniformly use the cutting blade, a sheet aftertreatment apparatus equipped with the sheet cutting apparatus, and an image forming apparatus whose apparatus main body has the sheet aftertreatment apparatus as one of its components.

2. Related Background Art

Conventionally, a sheet cutting apparatus which cuts a sheet, a sheet stack, etc. (hereinafter referred to as "sheets to be cut") with a cutting blade is provided in a sheet aftertreatment apparatus as one of the components of the sheet aftertreatment apparatus which is provided in the apparatus main body of an image forming apparatus. The sheet aftertreatment apparatus binds sheets discharged from the apparatus main body of the image forming apparatus into a stack, and then performs glue binding or saddle-stitch/buckle binding. To align the end surface of the bound sheets, an end portion of the sheet stack is cut off by the sheet cutting apparatus (Japanese Patent Application Laid-open No. 2003-292230). The sheet cutting apparatus may cut not only a sheet stack but also a single sheet. In other words, the sheet cutting apparatus is adapted to cut different forms of sheets to be cut, which may be a sheet stack or a single sheet. The image forming apparatus is an apparatus for forming an image on a sheet, and may be a copying machine, a printer, a facsimile apparatus, a multifunctional apparatus composed of those apparatuses, etc.

In the conventional sheet cutting apparatus, regardless of the size of the sheets to be cut, sheets are always fed to the same position and cut there. Thus, the cutting blade is not uniformly used over its entire length but includes a portion always used for cutting regardless of the size of the sheets to be cut, and a portion not used for cutting according to the size of the sheets to be cut, resulting in a variation in wear. As a result, when its portion constantly used has lost its sharpness, the cutting blade must be replaced by a new one even if it includes a portion which is not much used and, consequently, cuts well. Thus, the cutting blade cannot be used for a long period of time.

Further, the sheet aftertreatment apparatus equipped with the sheet cutting apparatus requires temporary suspension of after-treatment operation in order to replace the cutting blade, resulting in a rather low operating efficiency (availability ratio).

Furthermore, due to the low operating efficiency (availability ratio) of the sheet aftertreatment apparatus, the conventional image forming apparatus equipped with the sheet aftertreatment apparatus having such a sheet cutting apparatus exhibits a rather low operating efficiency (availability ratio).

SUMMARY OF THE INVENTION

An object of the present invention is to provide a sheet cutting apparatus which allows uniform use of the cutting blade to thereby reduce the number of times for replacing the cutting blade.

Another object of the present invention is to provide a sheet aftertreatment apparatus equipped with a sheet cutting apparatus in which the number of times for replacing the cutting blade has been reduced, thereby achieving an enhanced operating efficiency (availability ratio).

Still another object of the present invention is to provide an image forming apparatus improved in terms of productivity in image formation through provision of a sheet aftertreatment apparatus with an enhanced operating efficiency (availability ratio).

A sheet cutting apparatus according to the present invention includes: a cutting blade for cutting a sheet to be cut which includes a sheet and a sheet stack; and a transport means capable of holding and rotating the sheet to be cut to cause an end portion of the sheet to be cut to be opposed to the cutting blade and transporting the sheet to be cut to a position where the end portion is cut by the cutting blade.

The transport means is capable of selectively holding, based on the size of the sheet to be cut, a portion of the sheet to be cut which is a central position of the sheet to be cut with respect to a direction crossing a direction in which the sheet to be cut is conveyed and which is an arbitrary position of the sheet to be cut along the conveying direction.

A sheet aftertreatment apparatus according to the present invention includes: an alignment means for aligning an end portion of at least one side of a sheet stack; and the sheet cutting apparatus for cutting the sheet stack aligned by the alignment means.

A sheet aftertreatment apparatus according to the present invention may include: the sheet cutting apparatus; and a supply means for supplying the sheet to be cut to the transport means, with a central position of the sheet to be cut with respect to a direction crossing a direction in which the sheet to be cut is supplied being matched with a central position of the sheet to be cut with respect to a direction crossing a direction in which the sheet to be cut is conveyed in the transport means of the sheet cutting apparatus.

An image forming apparatus according to the present invention includes: an image forming means for forming an image on a sheet; and any one of the sheet aftertreatment apparatuses for cutting a sheet to be cut on which an image has been formed by the image forming means.

These and other objects, features and advantages of the present invention will become more apparent upon consideration of the following description of the preferred embodiments of the present invention taken in conjunction with the accompanying drawings.

BRIEF DESCRIPTION OF THE DRAWINGS

FIGS. 6A, 6B, 6C, and 6D are diagrams for illustrating a binding process of attaching a cover sheet to a glued sheet stack, in which: FIG. 6A is a diagram showing a state where the operation of attaching the cover sheet to the glued sheet stack is started; FIG. 6B is a diagram showing a state where a cover attaching path is opened and the glued sheet stack starts to descend; FIG. 6C is a diagram showing a state where the cover sheet is attached to the glued sheet stack; and FIG. 6D is a diagram showing a state where the attachment of the cover sheet to the glued sheet stack has been completed;

FIGS. 8A, 8B, and 8C are explanatory front views for illustrating the operation of a rotation stage, in which: FIG. 8A is a diagram showing a state where a bound sheet stack starts to be fed from a conveyance/alignment unit; FIG. 8B is a diagram showing in a state where the bound sheet stack is received from the conveyance/alignment unit; and FIG. 8C is a diagram showing a state where the sheet stack is conveyed from the rotation stage to a cutting blade;

FIGS. 11A and 11B are diagrams for illustrating the operation of a sheet stack presser, in which: FIG. 11A is a diagram showing a state where the sheet stack presser pressurizes a bound sheet stack and the cutting blade starts to cut the bound sheet stack; and FIG. 11B is a diagram showing a state where the sheet stack presser and the cutting blade are detached from the bound sheet stack;

DESCRIPTION OF THE PREFERRED EMBODIMENTS

A sheet cutting apparatus according to an embodiment of the present invention, a sheet aftertreatment apparatus equipped with this sheet cutting apparatus, and copying machine constituting an example of an image forming apparatus whose apparatus main body has this sheet aftertreatment apparatus as one of its components, will be described with reference to the drawings. The values mentioned in the description of this embodiment are only given for reference purposes, and should not be construed restrictively.

The image forming apparatus may be a copying machine, a printer, a facsimile apparatus, a multifunctional apparatus composed of these apparatuses, etc. That is, the image forming apparatus is not restricted to a copying machine. Further, the sheet aftertreatment apparatus is not always provided in the apparatus main body of a copying machine. It may also be provided in the apparatus main body of a printer, a facsimile apparatus, a multifunctional apparatus composed of those apparatuses, etc.

Figure 1:
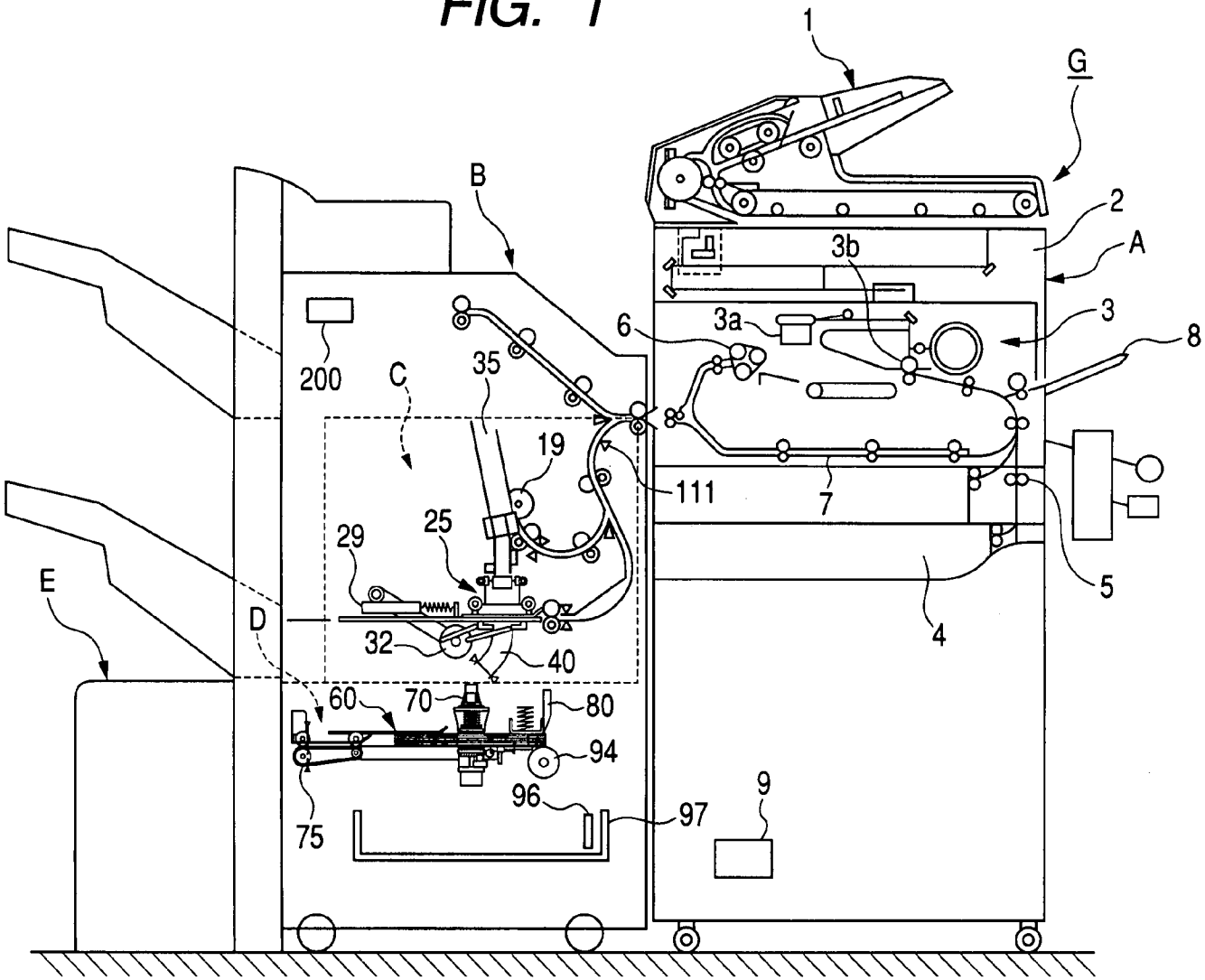
FIG. 1 is a schematic front sectional view of a copying machine constituting an example of an image forming apparatus whose apparatus main body is equipped with a sheet aftertreatment apparatus according to an embodiment of the present invention.

As shown in FIG. 1, a copying machine G according to this embodiment is composed of an apparatus main body A, and a sheet aftertreatment apparatus B having a trimmer unit D. It is also possible for the apparatus main body A and the sheet aftertreatment apparatus B to be used separately.

Further, while in FIG. 1 the sheet aftertreatment apparatus B is provided by the side of the apparatus main body A of the copying machine G as one of the components of the copying machine G, it may also be incorporated into the apparatus main body A.

Further, the apparatus main body A of the copying machine is provided with a control portion 9 for controlling the apparatus main body A, and the sheet aftertreatment apparatus is equipped with a central processing unit (hereinafter referred to as the "CPU") 200 which performs transmission and reception of data, control signals, etc. to and from the control portion 9 of the apparatus main body A to control the sheet aftertreatment apparatus. It is also possible to integrate the control portion 9 and the CPU 200 with each other and to provide the resultant integrated control portion in one of the apparatus main body A and the sheet aftertreatment apparatus to thereby control the apparatus main body A and the sheet aftertreatment apparatus.

While in the sheet aftertreatment apparatus of this embodiment the sheets are stacked together and then glued to be bound, it is also possible to effect saddle-stitch/buckle binding on the sheets after stacking them together. Further, it is also possible to effect staple binding with a stapler.

While the sheet cutting apparatus of this embodiment cuts a glue-bound sheet stack, it can also cut a saddle-stitch/buckle-bound sheet stack or an unbound sheet stack.

Further, the sheet cutting apparatus of this embodiment can cut not only a sheet stack but also a single sheet. That is, the sheet cutting apparatus of this embodiment can cut sheets to be cut in the form of a single sheet, a sheet stack, etc. In the following, the case in which a sheet stack is cut will be described.

(General Construction of the Copying Machine)

FIG. 1 is a schematic front sectional view of a copying machine constituting an example of an image forming apparatus whose apparatus main body is equipped with a sheet aftertreatment apparatus having a sheet cutting apparatus according to an embodiment of the present invention. The apparatus main body A of the copying machine G optically reads an original automatically fed from an original feeding device 1 provided in the upper portion of the apparatus at a scanner portion 2, and transmits as a digital signal the information thus obtained to the image forming means such as an image forming portion 3, thus recording the information on a sheet such as an ordinary paper sheet or an OHP sheet.

In the lower portion of the apparatus main body A of the copying machine G, a plurality of sheet cassettes 4 accommodating sheets of various sizes are provided such that they can be drawn out (FIG. 1 only shows one of them, omitting the others). A sheet conveyed from the sheet cassettes 4 by conveying rollers 5 undergoes an image recording using an electrophotographic method at the image forming portion 3.

That is, based on the information read at the scanner portion 2, the apparatus main body A applies a laser beam from a light emitting portion 3*a* to a photosensitive drum 3*b* to form a latent image, which is developed with toner and transferred to the sheet. Thereafter, the apparatus main body A conveys the sheet to a fixing portion 6, where the toner image is permanently fixed to the sheet by heating and pressurization. Then, in a one-side recording mode in which a toner image is formed on one side of a sheet, the apparatus main body A sends the sheet as it is to the sheet aftertreatment apparatus B.

In a two-side recording mode in which toner images are formed on both sides of a sheet, the apparatus main body A effects switch back conveyance on the sheet with the image recorded on one side thereof and reverses it before conveying it to a re-conveyance path 7. Then, the apparatus main body A conveys the sheet to the image forming portion 3 again to form an image also on the other side of the sheet before sending it to the sheet aftertreatment apparatus B. Before sending the sheet to the sheet aftertreatment apparatus B, the apparatus main body A supplies the sheet aftertreatment apparatus B with a signal indicating the sheet size, etc., causing the sheet aftertreatment apparatus B to previously perform path switching therein, etc.

Apart from the feeding from the sheet cassette 4, the sheet can also be fed manually from a multiple tray 8.

Figure 2:
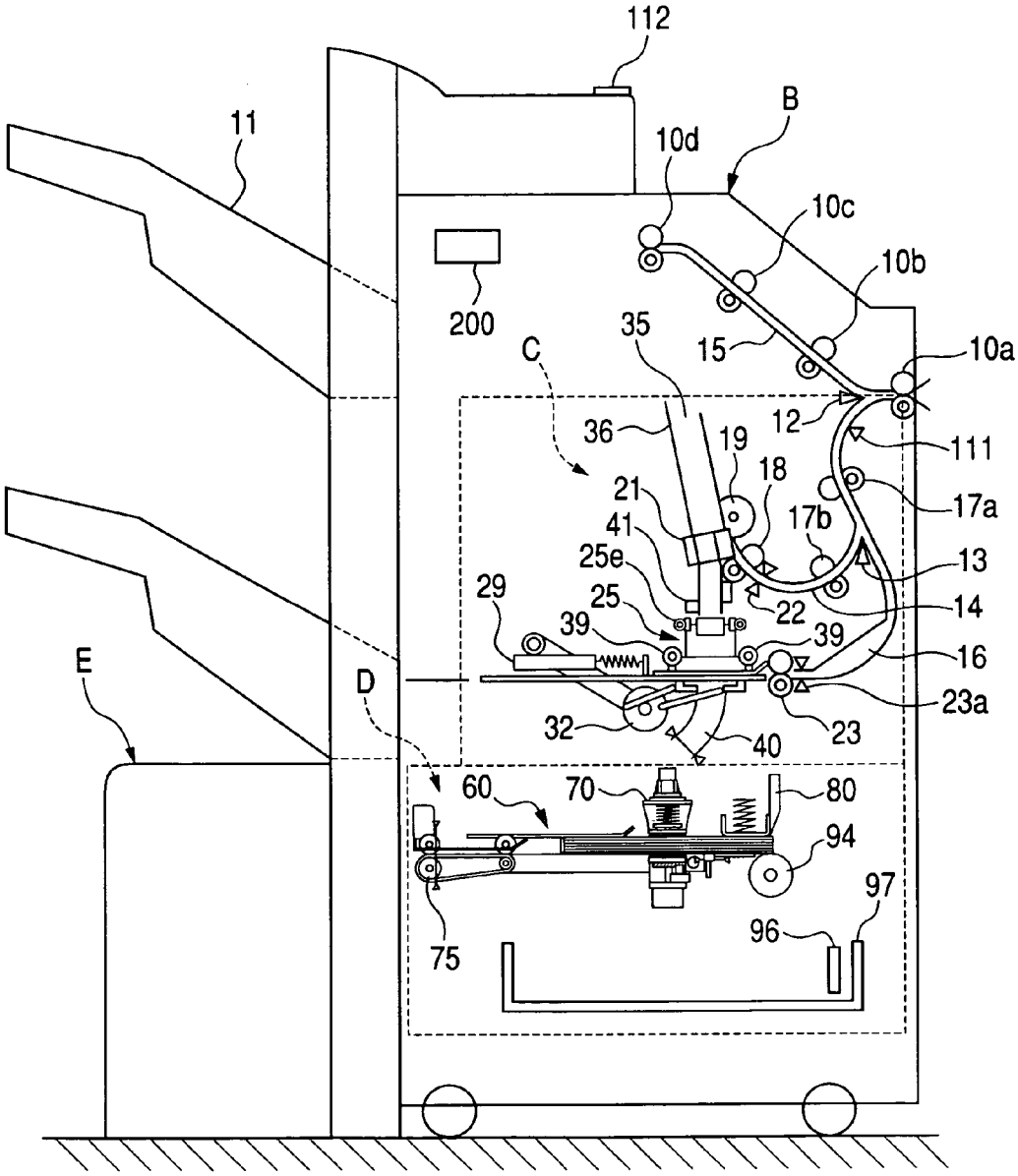
FIG. 2 is a sectional view of the sheet aftertreatment apparatus according to the present invention.

As shown in FIG. 2, the sheet aftertreatment apparatus B is composed, for example, of a conveyance/alignment unit C serving as a supply means, and a trimmer unit D. Apart from the operation of the ordinary discharge mode, the sheet aftertreatment apparatus B can selectively conduct glue-binding and cutting; it can cut the three sides of a sheet stack other than the glued side. It is not always necessary for the sheet aftertreatment apparatus B to be provided with the conveyance/alignment unit C. It is also possible for the aftertreatment apparatus B to be solely capable of cutting sheet stacks. Further, it is not always necessary for the trimmer unit D to cut the three sides of a sheet stack. It may also cut one side only.

In the normal mode, a sheet P discharged from the apparatus main body A of the copying machine G to the sheet aftertreatment apparatus B is conveyed by conveying roller pairs 10*a*, 10*b*, 10*c*, and 10*d*, and discharged onto a stack tray 11. In the glue-binding mode, the sheet P undergoes a predetermined treatment described below, and is discharged onto a stacking tray E.

(Control Portion of the Sheet Aftertreatment Apparatus)

Figure 4:
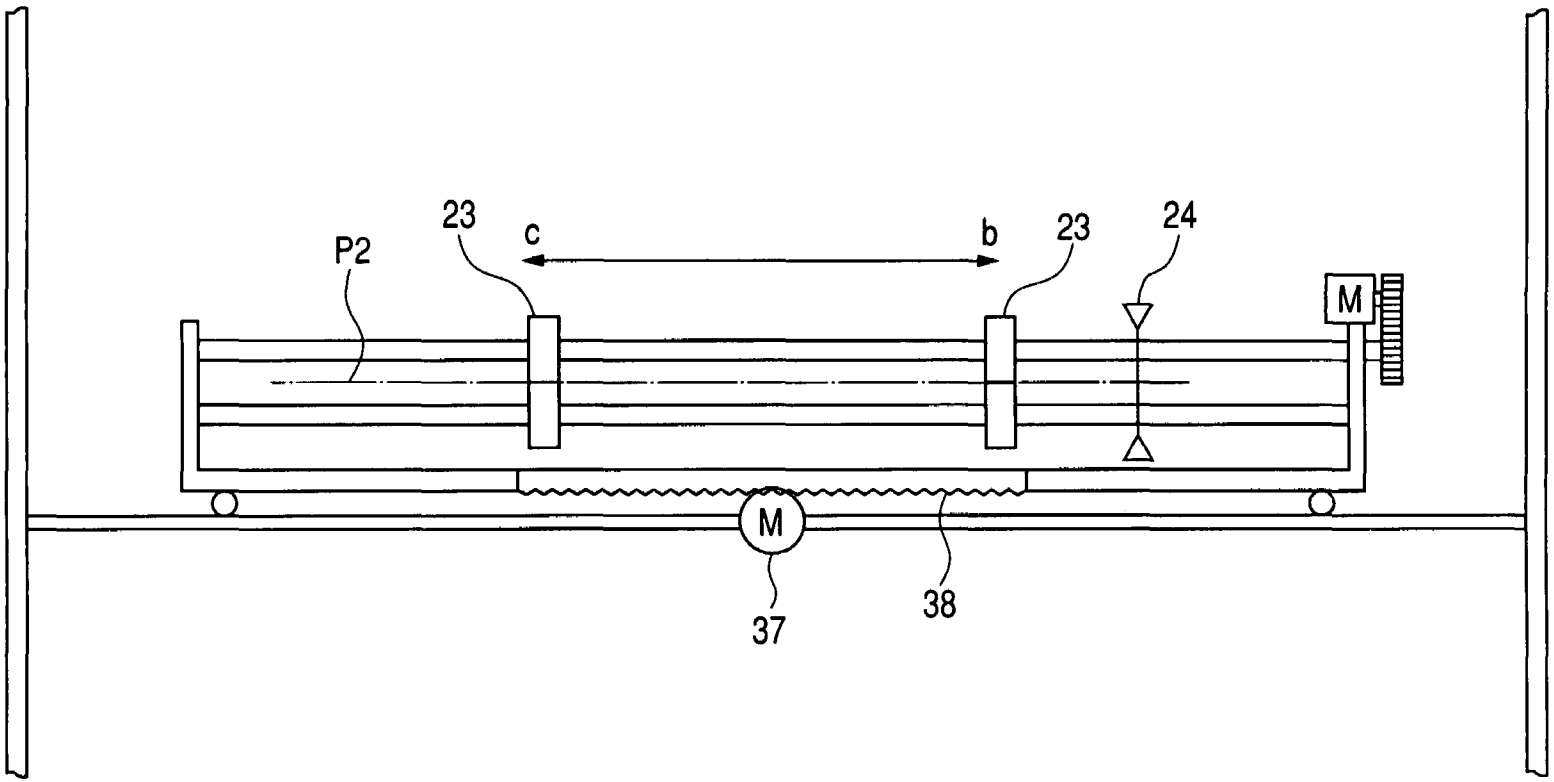
FIG. 4 is a diagram showing a registration roller pair as seen from the right-hand side in FIG. 2.
Figure 15:
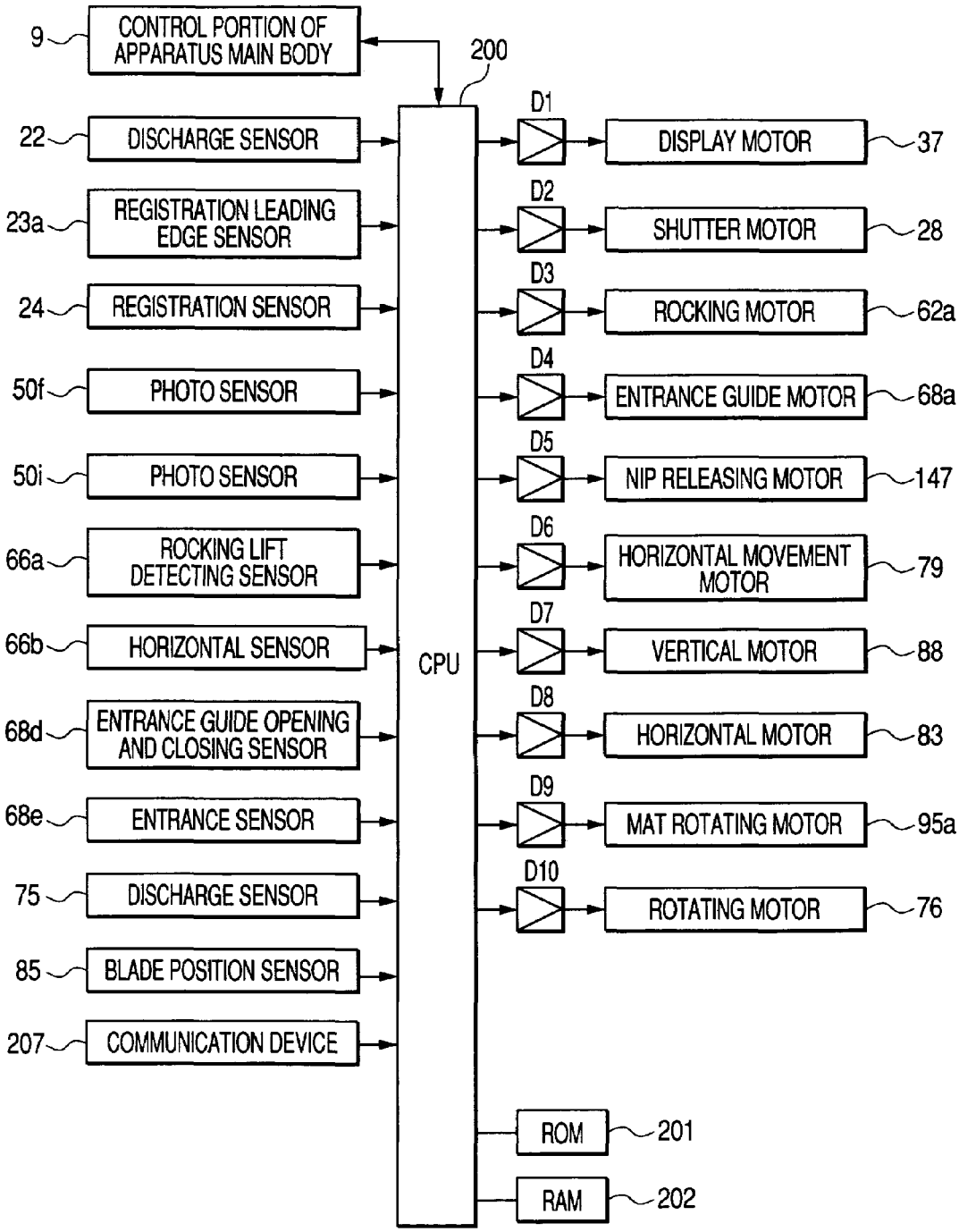
FIG. 15 is a control block diagrams for a sheet aftertreatment apparatus.

FIG. 15 shows the control system for the sheet aftertreatment apparatus B. In FIG. 15, as the control means of this embodiment, there are electrically connected to the input side of the CPU 200 a discharge sensor 22 for detecting a sheet fed to an alignment longitudinal path 35 (see FIG. 2); a registration leading edge sensor 23*a* for detecting whether the sheet has been sent to a registration roller pair 23 or not; a registration sensor 24 (see FIG. 4) for detecting movement of the sheet in a direction crossing the sheet conveying direction; photo sensors 50*f* (see FIG. 7) for detecting movement of moving members 50*n*; photo sensors 50*i* for detecting movement of reception tables 50*a* and racks 50*b*; a rocking lift detecting sensor 66*a* (see FIG. 8A) for detecting upward rotation of a rocking unit 61; a horizontal sensor 66*b* for detecting downward rotation of the rocking unit 61; an entrance guide opening and closing sensor 68*d* for detecting movement of an entrance guide 67; an entrance sensor 68*e* for detecting a sheet fed to the entrance guide 67; a discharge sensor 75 for detecting a sheet discharged from a rotation stage 60; a blade position sensor 85 for detecting the position of a cutting blade 80; a communication device 207 for transmitting sheet size data designated by the user to the CPU 200, and the like.

Electrically connected to the output side of the CPU 200 through drivers D1, D2, D3, D4, D5, D6, D7, D8, D9, and D10 are respectives of a cover motor 37 (see FIG. 4) for moving a cover sheet P2, a shutter motor 28 for operating creasing tables 34 (see FIGS. 6A through 6D), a rocking motor 62*a* for rotating a rocking unit 61 (see FIGS. 8A, 8B and 8C), an entrance guide motor 68 for moving an entrance guide 67 (see FIG. 8A), a nip releasing motor 147 for releasing the nipping of a bound sheet stack by a gripper unit 70, a horizontal movement motor 79 (see FIG. 9) for moving the gripper unit 70, a vertical motor 88 (see FIG. 11A) for raising and lowering a sheet presser 93, a horizontal motor 83 (see FIG. 10) for moving the cutting blade 80 in a direction parallel to the sheet surface, a mat rotating motor 95*a* for rotating a mat 94 (see FIG. 12), a rotating motor 76 for rotating a rotation guide gear 78 (see FIG. 8C), a plunger (not shown), etc.

Further, as storage portions, the CPU 200 has, for example, a read only memory (ROM) 201 and a random access memory (RAM) 202. The ROM 201 stores, for example, a control program corresponding to cutting control procedures (described later) for bound sheet stacks of different sizes to be executed by the CPU 200. The RAM 202 is a portion that temporarily stores information such as computation data of the CPU 200 and a sheet size inputted by the user.

When signals from the above-mentioned respective sensors and the ROM 201 and the RAM 202 are input thereto, the CPU 200 executes the control program based on the signals, controlling the respective motors, plunger (not shown), etc. so cutting control, etc. can be executed. Further, signals are transmitted and received between the CPU 200 and the control portion 9 in the apparatus main body A of the copying machine G to thereby control the sheet aftertreatment apparatus B as a whole.

(Stacking on the Alignment Longitudinal Path)

Figure 3A:
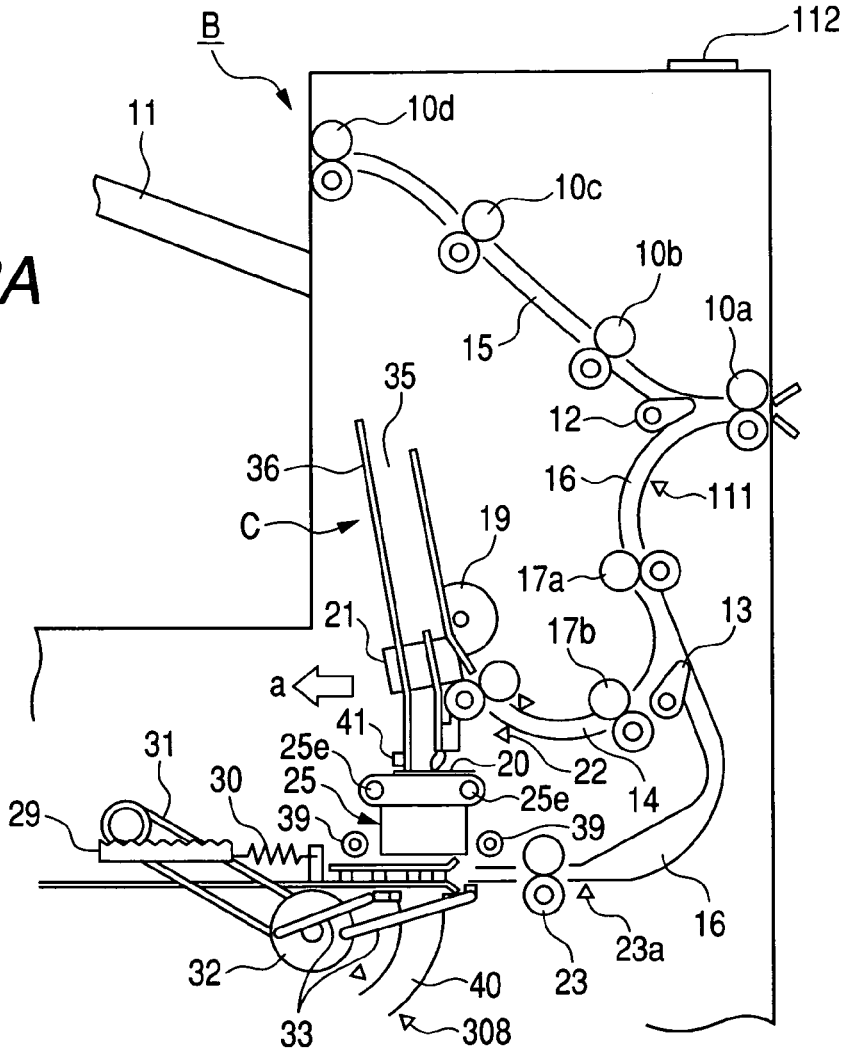
FIG. 3A is a schematic general front view of the conveyance/alignment unit in the sheet aftertreatment apparatus of FIG. 2.
Figure 3B:
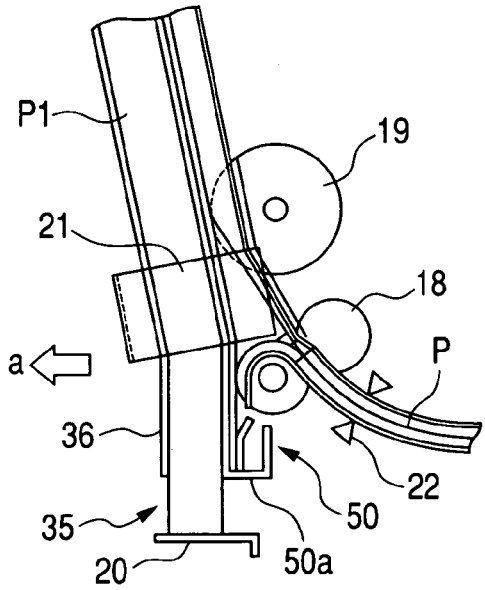
FIG. 3B is an enlarged front view of the buffer mechanism.

In the binding mode, the sheet P discharged from the apparatus main body A is guided by a first flapper 12 and a second flapper 13 shown in FIGS. 2, 3A and 3B to be fed to a sheet binding path 14. The first flapper 12 effects switching between a non-sorting path 15 and a cover path 16. The second flapper 13 effects switching between the sheet binding path 14 and the cover path 16.

The sheet P conveyed by the conveying roller pairs 10*a*, 17*a*, and 17*b* is discharged into the alignment longitudinal path 35 by a discharge roller pair 18, and then returned by a semicircular roller 19 and the discharge roller pair 18 to a position where the trailing edge of the sheet P abuts a trailing-edge stopper 20 to effect alignment in the sheet conveying direction (trailing edge alignment). Then, the sheet P is pushed-in in the direction of the sheet center by, for example, an alignment plate 21 serving as an alignment means, and alignment in a direction crossing the sheet conveying direction is effected. That is, the sheet P is pushed-in in the direction of the center with respect to the sheet width direction (the direction crossing the sheet conveying direction), and the side ends of the sheet are aligned.

When the trailing edge of the sheet P passes the discharge roller pair 18, the discharge roller pair 18 is controlled so as to be reduced in rotating speed. As a result, the sheet P discharged into the alignment longitudinal path 35 is reliably fed to the alignment longitudinal path 35 by the rotation of the semicircular roller 19, thus reliably effecting trailing edge alignment.

When a predetermined period of time has elapsed after the passing of the trailing edge of the sheet through the discharge sensor 22, or when the motor RPM has attained a predetermined RPM, the sheet is regarded to have passed the discharge roller pair 18.

(Semicircular Roller)

Next, the semicircular roller 19, which pulls back the sheet P discharged into the alignment longitudinal path 35 in a direction opposite to the discharging direction, will be described.

As shown in FIG. 3B, the semicircular roller 19 is cut out into a semicircular configuration. Normally, the cutout portion of the semicircular roller 19 is situated on the alignment longitudinal path 35 side, so that the semicircular roller 19 does not hinder the discharge of the sheet P discharged from the discharge roller pair 18. Each time one sheet P is discharged into the alignment longitudinal path 35, the semicircular roller 19 rotates in a direction opposite to the sheet discharging direction of the discharge roller pair 18, and comes into contact with the trailing edge of the sheet P in the alignment longitudinal path 35, pulling back the sheet P by frictional force caused between the semicircular roller 19 and the sheet P. That is, the semicircular roller 19 pulls back the sheet P in a direction where the sheet P falls.

(Alignment Longitudinal Path Plate)

An alignment longitudinal path plate 36 can be moved in a direction indicated by an arrow a in FIGS. 3A and 3B by an alignment longitudinal path motor (not shown), making it possible to adjust the path gap of the alignment longitudinal path 35. In order to maintain substantially at a fixed level a contact pressure of the semicircular roller 19 with respect to the uppermost one of the sheets discharged into the alignment longitudinal path 35, the alignment longitudinal path plate 36 moves the alignment longitudinal path plate 36 such that the path is widened based on the number of sheets discharged into the alignment longitudinal path 35.

(Operating Timing of the Semicircular Roller)

The semicircular roller 19 is operated after the discharge roller pair 18 has released the trailing edge of the sheet P. More specifically, the semicircular roller 19 rotates in a direction opposite to the sheet discharging direction after a predetermined period of time has elapsed since the passing of the trailing edge of the sheet P through the discharge sensor 22 provided on the upstream side of the discharge roller pair 18.

(Cover Path)

The sheet P discharged from the apparatus main body A is guided to the cover path 16 by the first flapper 12 and the second flapper 13. As shown in FIG. 2 (see FIGS. 3A and 3B) and FIG. 4, halfway through the cover path 16, there are arranged a registration roller pair 23 and a registration leading edge sensor 23*a* provided on the upstream side of the registration roller pair 23. At the point in time when the cover sheet P2 is guided to the cover path 16, the registration roller pair 23 is at rest. It starts to rotate after a fixed period of time since the abutment of the leading edge of the cover sheet P2 with the registration roller pair 23. A judgment as to whether the leading edge of the cover sheet P2 has come into contact with the registration pair 23 or not is made by checking whether a predetermined time has elapsed after the passing of the cover sheet P2 through the registration leading edge sensor 23*a* or detecting the motor RPM. By effecting control so as to keep the registration roller pair 23 at rest, a loop is formed at the leading edge of the cover sheet P2 guided to the cover path 16, making it possible to effect skew feed correction.

The registration roller pair 23 can be moved in a direction perpendicular to the sheet conveying direction (i.e., a direction crossing the same or the sheet width direction) by the cover motor 37 and a rack 38. After the trailing edge of the cover sheet P2 has left the conveying roller pair 17*a*, the registration roller pair 23 moves in the direction indicated by the arrow b in FIG. 4 while nipping and conveying the cover sheet P2, and the registration sensor 24 is shielded. Thereafter, the registration roller pair 23 moves in the direction indicated by the arrow c to release the registration sensor 24, and stops after moving by a fixed amount. The registration sensor 24 is arranged at a sheet end position (side end position) of the sheet stack P1 in the alignment longitudinal path 35, so that the cover sheet P2 in the cover path 16 and the sheet stack P1 in the alignment longitudinal path 35 move to positions deviated by a fixed amount in a direction perpendicular to the sheet conveying direction (i.e., a direction crossing the same or the width direction of the sheet and the sheet stack). The registration roller pair 23 receives a sheet size signal from the apparatus main body A, and conveys the cover sheet P2 in the cover path 16 by a predetermined amount based on the sheet size before stopping.

(Gripper)

A gripper 41, shown in FIGS. 3A and 3B and FIGS. 6A through 6D, is situated in the lower portion of the alignment longitudinal path 35, and grips the sheet stack P1 placed in the alignment longitudinal path 35, thus guiding it to the cover sheet P2.

(Gluing Unit)

Figure 5:
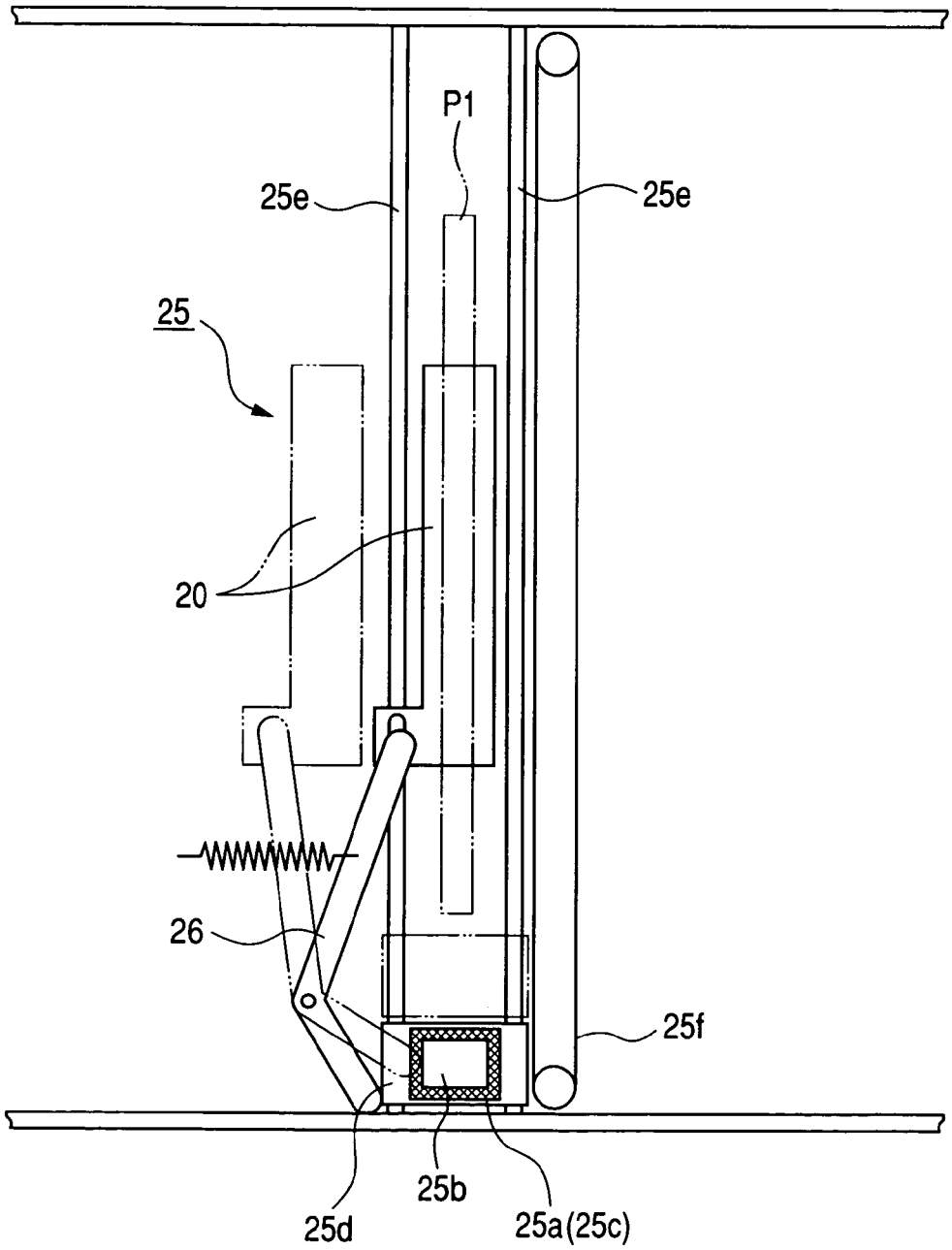
FIG. 5 is a schematic plan view of a gluing unit.

FIG. 5 is a schematic plan view of a gluing unit 25. The gluing unit 25 is composed of a tub 25*a*, a glue roller 25*b*, a glue 25*c*, a tub heater 25*d*, shafts 25*e*, a tub driving portion 25*f*, etc.

The tub 25*a* is adapted to move along the shafts 25*e* in the sheet width direction, which is perpendicular to the sheet conveying direction, by the tub driving portion 25*f* by an amount not less than the sheet width, and has two retracted positions (the upper edge side and the lower edge side in FIG. 5) outside the sheet width. As the tub 25*a* moves from the first retracted position to the second retracted position, a part of the tub 25*a* pushes a part of a link 26 engaged with a trailing edge stopper 20, causing the trailing edge stopper 20 to move such that it is retracted from the lower portion of the sheet stack P1 of FIG. 3B. The glue roller 25*b* is mounted to the tub 25*a*, and rotates as the tub 25*a* moves.

The tub heater 25*d* is mounted to the outer side of the tub 25*a*. At the start of the binding mode, the-tub heater 25*d* heats the tub 25*a*, and melts the glue 25*c* in the tub 25*a*. Through movement of the tub 25*a* by the tub driving portion 25*f*, the glue roller 25*b* rotates, and the molten glue 25*c* is spread over the entire outer peripheral surface of the glue roller 25*b*.

The sheet stack P1 placed in the alignment longitudinal path 35 is held by the gripper 41 (see FIG. 3A), and the tub 25*a* moves from the first retracted position to the second retracted position to cause the trailing edge stopper 20 to be retracted from the lower portion of the sheet stack P1, whereby the glue 25*c* is applied to the lower end surface of the sheet stack P1 by the gluing unit 25.

(Binding Process)

Figure 6A:
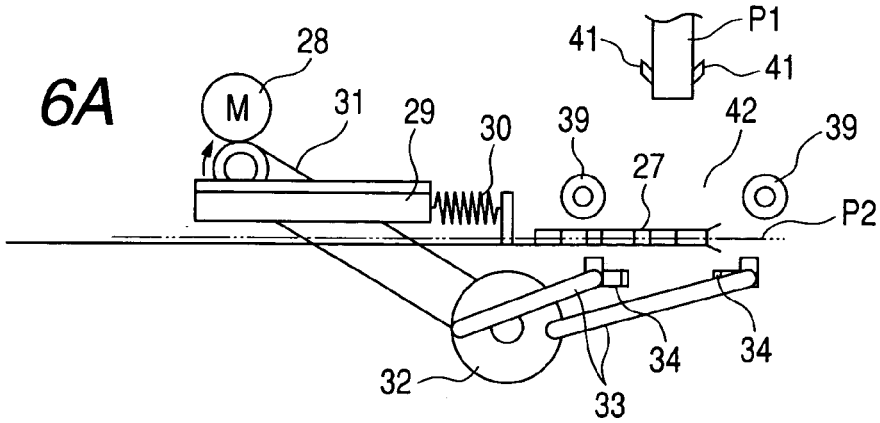

As shown in FIG. 6A, a shutter path 27 is situated on the downstream side of the cover path 16 (see FIG. 2); when the cover sheet P2 is being conveyed, it keeps a cover attachment path 42 closed.

Figure 6B:
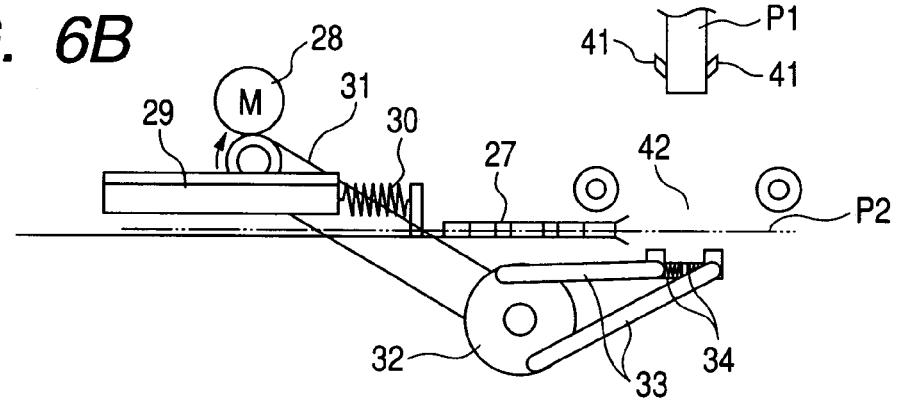

As shown in FIG. 6B, during the binding process, a shutter motor 28 drives a shutter rack 29 to move the shutter path 27 and a spring 30 pulling the shutter rack 29 in one direction to positions where the shutter path 27 and the spring 30 open the cover attachment path 42. After opening the cover attachment path 42, the shutter path 27 abuts a stopper (not shown) and stops.

The glue 25*c* is applied to the sheet stack P1 held by the gripper 41 by the gluing unit 25 shown in FIG. 5. Thereafter, the gripper 41 moves the glued sheet stack P1 such that the glued sheet stack P1 is brought into press contact with the cover sheet P2 on the creasing tables 34, thereby the sheet stack P1 is brought into press contact with the cover sheet P2.

Figure 6C:
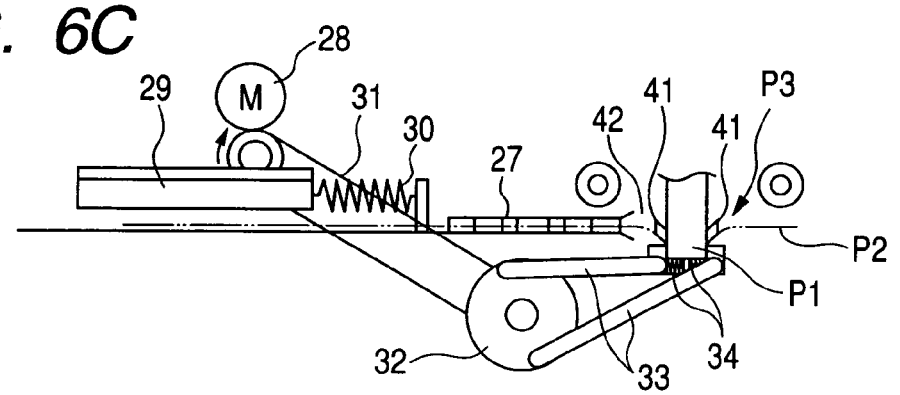

Next, as shown in FIG. 6C, when the shutter motor 28 is further driven, a cam 32 is also rotated by the shutter motor 28 through a belt 31, and the creasing tables 34 are brought close to each other by guide shafts 33. The creasing tables 34 perform creasing for a fixed period of time, whereby a bound sheet stack P3 is completed.

Figure 6D:
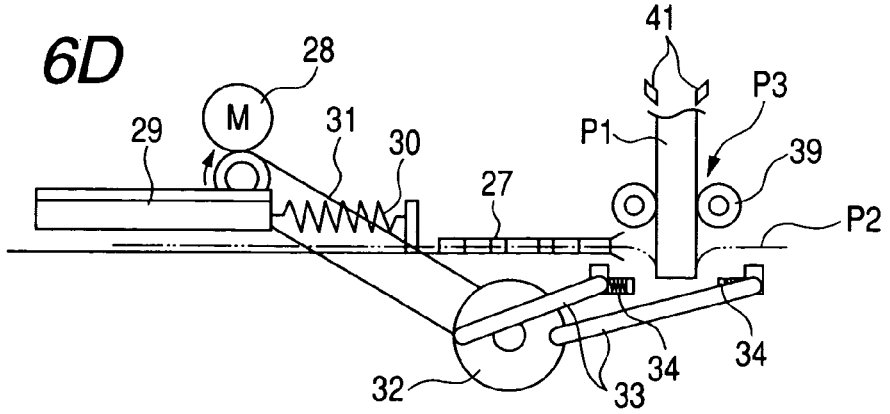

In order to cope with a variation in sheet thickness, the creasing tables 34 are provided with a clearance mechanism. Further, as shown in FIG. 6D, when the cam 32 continues to be rotated, the creasing tables 34 are separated and retracted from each other, whereby the bound sheet stack P3 is pushed downstream by extrusion rollers 39, and is conveyed to a stack curvature path 40 (see FIG. 2).

(Buffer Mechanism)

Figure 7:
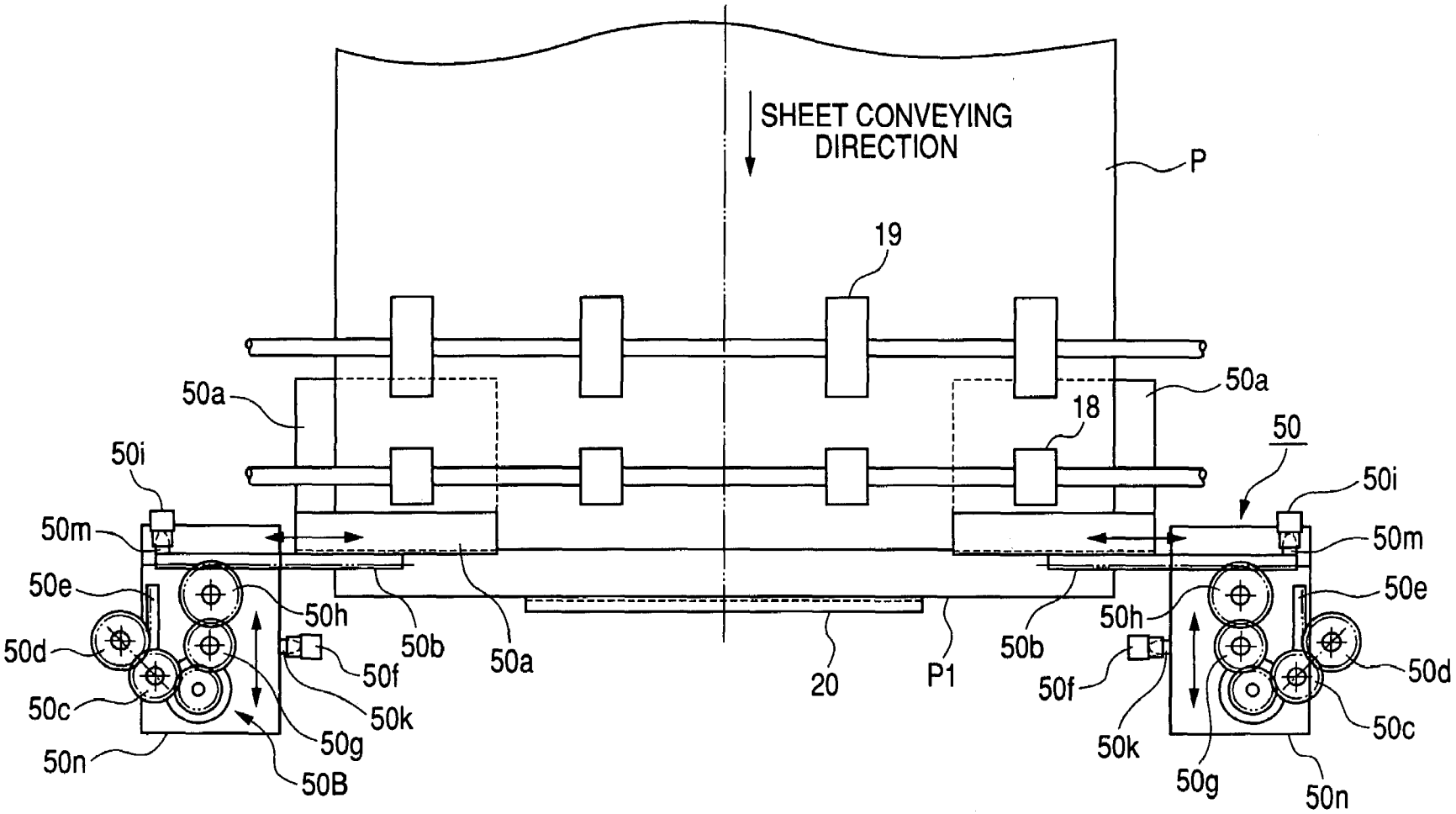
FIG. 7 is a side view of a buffer mechanism of an alignment longitudinal path.

A buffer mechanism 50 will be described with reference to FIGS. 3B and 7. At the time of sheet after-treatment, such as gluing and binding, the buffer mechanism 50 causes the sheet P conveyed from the apparatus main body A of the copying machine G to retract temporarily. Reception tables 50*a* of the buffer mechanism 50 receiving the sheet are adapted to move in the same direction as the sheet conveying direction and in a direction perpendicular thereto (a direction crossing the same or the sheet width direction). In FIG. 7, the discharge roller pairs 18, semicircular rollers 19, racks 50*e*, and photo sensors 50*f* are stationary.

To move the reception tables 50*a* in the same direction as the sheet conveying direction, first, solely electromagnetic clutch gears 50*c* are placed in a torque transmission state, making it possible to transmit the rotation of a motor (not shown) to gears 50*d*. Then, the gears 50*d* roll and rotate on the racks 50*e*, which are stationary. As a result, the respective portions of the buffer mechanism 50 except for the racks 50*e* move integrally in the same direction as the sheet conveying direction. That is, the reception tables 50*a* move in the same direction as the sheet conveying direction. At this time, by the photo sensors 50*f* and protrusions 50*k* on the moving members 50*n* shielding the photo sensors 50*f*, there are conducted detection of the moving position of the buffer mechanism 50 except for the racks 50*e* in the same direction as the sheet conveying direction and movement control based on the position thus detected.

Further, in order to move the reception tables 50*a* in the direction perpendicular to the sheet conveying direction (the direction crossing the same or the sheet width direction), solely electromagnetic clutch gears 50*g* are placed in a torque transmission state in which the rotation of the motor is transmitted to gears 50*h* to thereby move the racks 50*b*. As a result, the reception tables 50*a* are moved in the direction perpendicular to the sheet conveying direction. At this time, by photo sensors 50*i* provided on the moving members 50*n*, and protrusions 50*m* provided at one end of the racks 50*b* shielding the photo sensors 50*i*, there are conducted detection of the moving position of the reception tables 50*a* in the direction perpendicular to the sheet conveying direction and movement control based on the position thus detected. When no buffering is to be effected on the sheet P, the reception tables 50*a* of the buffer mechanism 50 are retracted to home positions outside the width of the sheet P as shown in FIG. 7, so that the reception tables 50*a* do not hinder the conveyance of the sheet.

The basic operation of the buffer mechanism 50 will be described. As shown in FIG. 3B, when the sheet stack P1 is in the alignment longitudinal path 35 in the state in which it is stacked and aligned on the trailing edge stopper 20, and it has not been discharged from the alignment longitudinal path 35, the buffer mechanism 50 slides, in order to buffer the sheets P sequentially conveyed from the apparatus main body A, the reception tables 50*a* from the home positions, where they do not hinder the conveyance of the sheets P, to the positions where they receive the sheets P through rotation of the gears 50*h* shown in FIG. 7 and movement of the racks 50*b*.

When the sheet stack P1 is discharged from the alignment longitudinal path 35 and there is no sheet stack P1 on the trailing edge stopper 20, the buffer mechanism 50 causes the reception tables 50*a* to move downstream with respect to the sheet conveying direction and toward the trailing edge stopper 20. When the trailing edge of the sheet P buffered is supported by the trailing edge stopper 20, the buffer mechanism 50 stops the movement of the reception tables 50*a*, causing them to retract to the home positions. The buffer mechanism 50 repeats the above operation until the target number of bound stacks is attained.

(Rotation Stage)

Next, the rotation stage 60 will be described with reference to FIGS. 8A, 8B, and 8C. The rotation stage 60 is adapted to rotate the bound sheet stack P3 to convey it into the trimmer unit D.

Figure 8A:
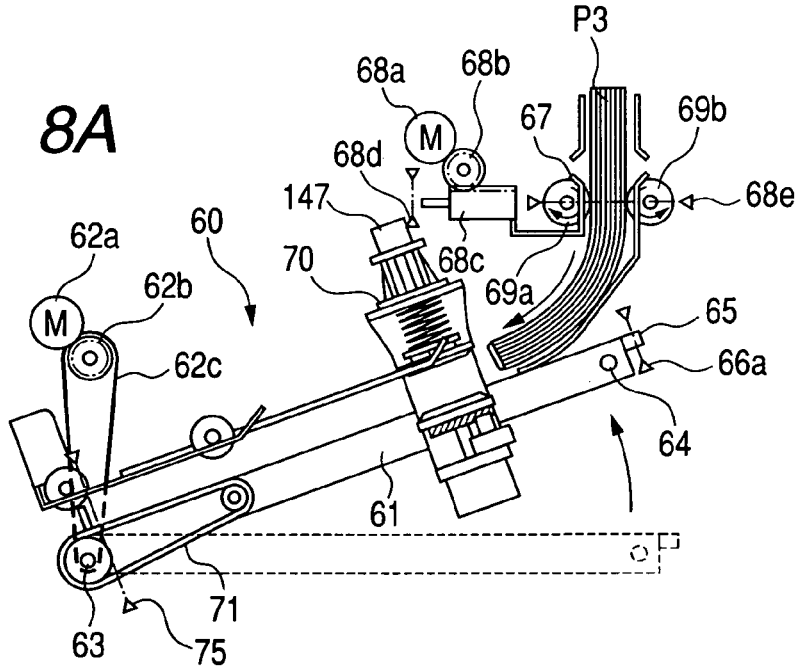

As shown in FIG. 8A, when the rocking motor 62*a* is started, the torque of the rocking motor 62*a* is transmitted to a rocking drive step gear (not shown) from a rocking ascent/descent gear 62*b* through a rocking ascent/descent belt 62*c*, and further, transmitted to a link mechanism (not shown) through a rocking drive belt (not shown) stretched between a rotation shaft 63 and a link shaft 64, with the rotation shaft 63 constituting the rotation center, whereby the right-hand end, as seen in FIG. 8A, of the rocking unit 61 in the rotation stage 60 is raised. The rise of the rocking unit 61 is detected through detection of a protrusion 65 of the rocking unit 61 by a rocking lift detecting sensor 66*a*. Upon receiving a signal indicating detection of the protrusion 65 from the rocking lift detecting sensor 66*a*, the CPU 200 stops the rocking motor 62*a*. The rocking unit 61 is on standby at the position shown in FIG. 8A.

Above the rocking unit 61, there is arranged an entrance guide 67 constituting the entrance to the trimmer unit D. An entrance guide motor 68*a* is started through control of the CPU 200 to rotate an entrance guide gear 68*b*, thereby moving an entrance rack 68*c* connected to the entrance guide 67. The entrance guide motor 68*a* further continues its rotation, and when the entrance rack 68*c* is detected by an entrance guide opening and closing sensor 68*d*, its rotation is stopped through control of the CPU 200, and the opening movement for the entrance guide 67 is stopped. The entrance guide 67 is on standby in the open state.

When the bound sheet stack P3 bound through the binding process, is sent to the entrance guide 67 from the conveyance/alignment unit C and detected by an entrance sensor 68*e*, the CPU 200 causes the entrance guide motor 68*a* to rotate based on a detection signal from the entrance sensor 68*e*, and brings the entrance guide 67 close to the bound sheet stack P3, thus pressing an entrance driven roller 69*a* against the bound sheet stack P3. Then, a stack conveying roller 69*b* rotates in the direction indicated by the arrow in FIG. 8A to send the bound sheet stack P3 to the rotation stage 60.

After conveying the bound sheet stack P3 by a fixed amount, the stack conveying roller 69*b* stops the conveyance of the bound sheet stack P3, with the bound sheet stack P3 being pressurized by the entrance drive roller 69*a* of the entrance guide 67.

Next, the bound sheet stack P3 is held by a gripper unit 70 and conveyed to a discharge belt 71. By being conveyed while held, the bound sheet stack P3 reliably reaches the discharge belt 71. The gripper unit 70 is provided on a support plate 141 shown in FIG. 9. The support plate 141 is provided on a pair of belts 144 each stretched between a pair of pulleys 142 and 143. The pulleys 142 are adapted to rotate by a horizontal movement motor 79. Thus, the gripper unit 70 is adapted to move horizontally as seen in FIGS. 8A through 8C and FIG. 9 by the horizontal movement motor 79.

The gripper unit 70 has a holding member 145 that holds the bound sheet stack P3 together with a rotation guide gear 78. The holding member 145 is urged toward the rotation guide gear 78 by a spring 146. Further, the holding member 145 is to be separated from the rotation guide gear 78 against the resilient force of the spring 146 through the rotation of a nip releasing motor 147.

Figure 8B:
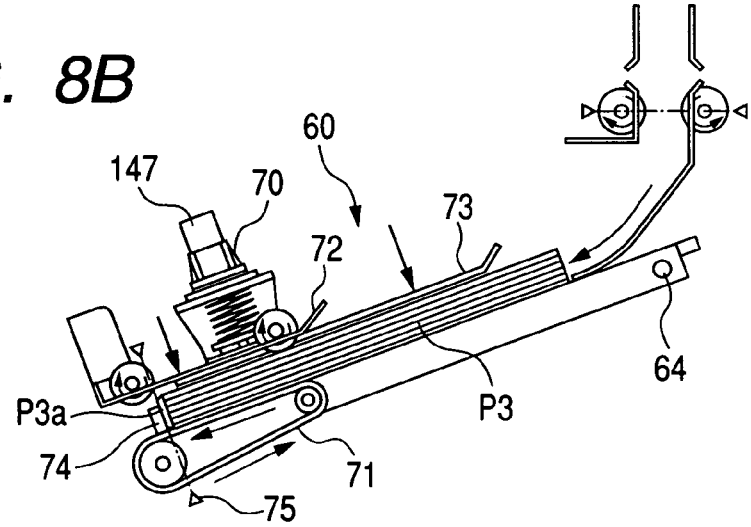

The bound sheet stack P3 conveyed to the discharge belt 71 is pressurized in the direction indicated the arrows in FIG. 8B by a surface presser unit 72 capable of moving toward and away from the bound sheet stack by a motor (not shown), and is also pressurized by an air vent unit 73 capable of moving toward and away from the bound sheet stack by the motor of the surface presser unit 72. In this way, after the operation of pressurizing the surface of the bound sheet stack P3 and the air vent operation have been effected on the bound sheet stack P3, the CPU 200 (see FIG. 15) releases the holding of the bound sheet stack P3 by the gripper unit 70, and causes the discharge belt 71 to run in the direction indicated by the arrows in FIG. 8B by a motor (not shown). Thereafter the CPU 200 causes a glued end portion P3*a* of the bound sheet stack P3 to abut a vertical movable registration plate 74, performing registration operation on the bound sheet stack P3. That is, skew feed correction is effected on the bound sheet stack P3.

At the same time, a discharge sensor 75 detects the glued end portion P3*a* of the bound sheet stack P3, so that the CPU 200 causes the discharge belt 71 to run for a predetermined period of time based on the detection signal thereof before stopping the running. Then, the CPU 200 moves the gripper unit 70 to the rotation center position of the bound sheet stack P3 and stops it there, causing the gripper unit 70 to hold the bound sheet stack P3.

After the gripper unit 70 has held the bound sheet stack P3, the rocking motor 62*a* shown in FIG. 8A is started. When the rocking motor 62*a* is started, the torque of the rocking motor 62*a* is transmitted to a rocking drive step gear (not shown) from the rocking ascent/descent gear 62*b* through the rocking ascent/descent belt 62*c*, and further, transmitted to a link mechanism (not shown) through a rocking drive belt (not shown) stretched between the rotation shaft 63 and the link shaft 64, with the rotation shaft 63 constituting the rotation center, whereby the right-hand end, as seen in FIG. 8C, of the rocking unit 61 descends. The descent of the rocking unit 61 is detected through detection of the protrusion 65 of the rocking unit 61 effected by a horizontal sensor 66*b*. Upon receiving a signal indicating the detection of the protrusion 65 from the horizontal sensor 66*b*, the CPU 200 stops the rocking motor 62*a*. The rocking unit 61 is on standby at the position shown in FIG. 8C.

Figure 8C:
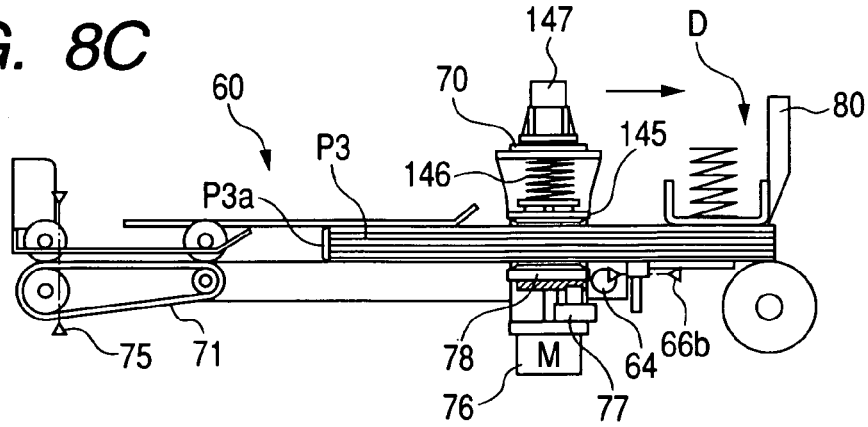
Figure 9:
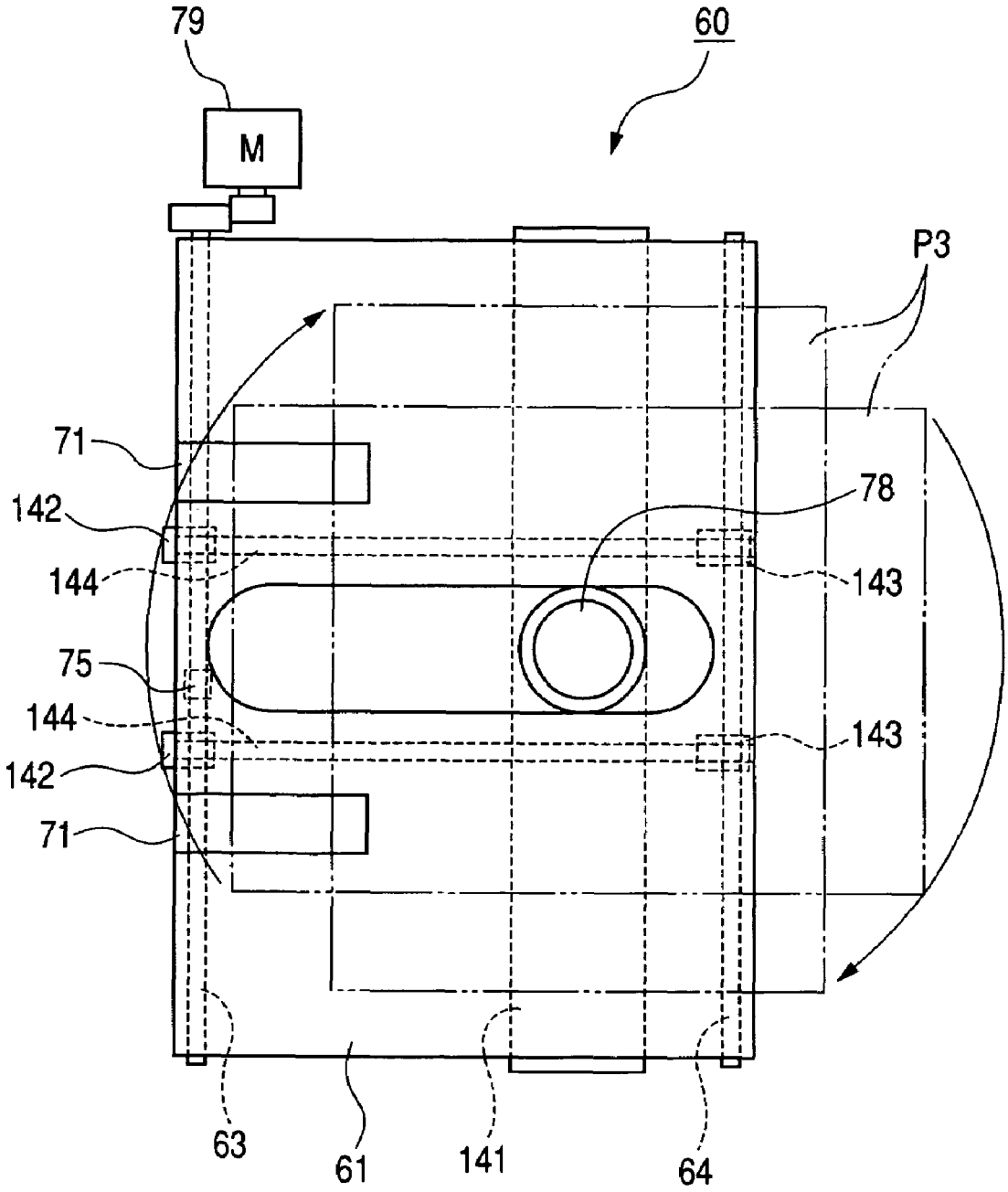
FIG. 9 is a plan view of the rotation stage.

As shown in FIG. 8C, the gripper unit 70 holds the bound sheet stack P3, and is moved in the direction indicated by the arrows by the horizontal movement motor 79 (see FIG. 9). The bound sheet stack P3 is conveyed to a predetermined position inside the trimmer unit D, and then cut. The end portion of the bound sheet stack P3 thus cut is parallel to the glued end portion P3*a*.

After the cutting of the bound sheet stack P3 is effected by the trimmer unit D, the gripper unit 70 moves, as shown in FIG. 9, to a predetermined rotating position while holding the bound sheet stack P3. Upon reaching the rotating position, the gripper unit 70 causes the bound sheet stack P3 to rotate by 90 degrees in the direction indicated by the arrows in FIG. 9. The gripper unit 70 is to be rotated by receiving the torque of the rotation motor 76 shown in FIG. 8C through the rotation gear 77 and the rotation guide gear 78.

After rotating the bound sheet stack P3 by 90 degrees, the gripper unit 70 temporarily moves the bound sheet stack P3 away from the trimmer unit D in order to grasp the relationship between the position where the bound sheet stack P3 is held and the next cutting position, causing the discharge sensor 75 to detect the end portion of the bound sheet stack P3. When the discharge sensor 75 detects the end portion of the bound sheet stack P3, the gripper unit 70 conveys the bound sheet stack P3 into the trimmer unit D again. The trimmer unit D cuts the end portion of the conveyed bound sheet stack P3 again. At this time, the end portion to be cut by the trimmer unit is at right angles with respect to the glued end portion P3*a*.

After the completion of the cutting, the gripper unit 70 conveys the bound sheet stack P3 to the predetermined rotating position again, and this time causes the bound sheet stack P3 to rotate by 180 degrees by the same rotating operation and in the same rotating direction as described above.

The gripper unit 70 has grasped the positional relationship between the position where the bound sheet stack P3 is held and the end portion of the bound sheet stack P3 in the foregoing cutting, so that, after rotating the bound sheet stack P3 by 180 degrees as described above, the gripper unit 70 conveys it again to the cutting position. The trimmer unit D again cuts the end portion of the conveyed bound sheet stack P3. At this time, the end portion to be cut by the trimmer unit is the remaining end portion at right angles with respect to the glued end portion P3*a*.

The gripper unit 70 rotates the bound sheet stack P3 cut in three directions again by 90 degrees by the same operation, and the glued end portion P3*a* of the bound sheet stack P3 is conveyed to the position where detection by the discharge sensor 75 is to be effected.

When the glued end portion P3*a* of the bound sheet stack P3 is detected by the discharge sensor 75, the gripper unit 70 cancels the holding of the bound sheet stack P3, and the surface presser unit 72 pressurizes the bound sheet stack P3. Thereafter, the discharge belt 71 runs counterclockwise as seen in FIG. 8B, and discharges the bound sheet stack P3 onto the stacking tray E.

(Trimmer Unit)

Next, the trimmer unit D will be described with reference to FIGS. 10, 11A, 11B, and 12. The trimmer unit D is adapted to cut the bound sheet stack P3 conveyed from the rotation stage 60. The rotation stage 60 is an example of a transport means. The construction composed of the rotation stage 60, the trimmer unit D, etc. is an example of the sheet cutting apparatus.

Figure 10:
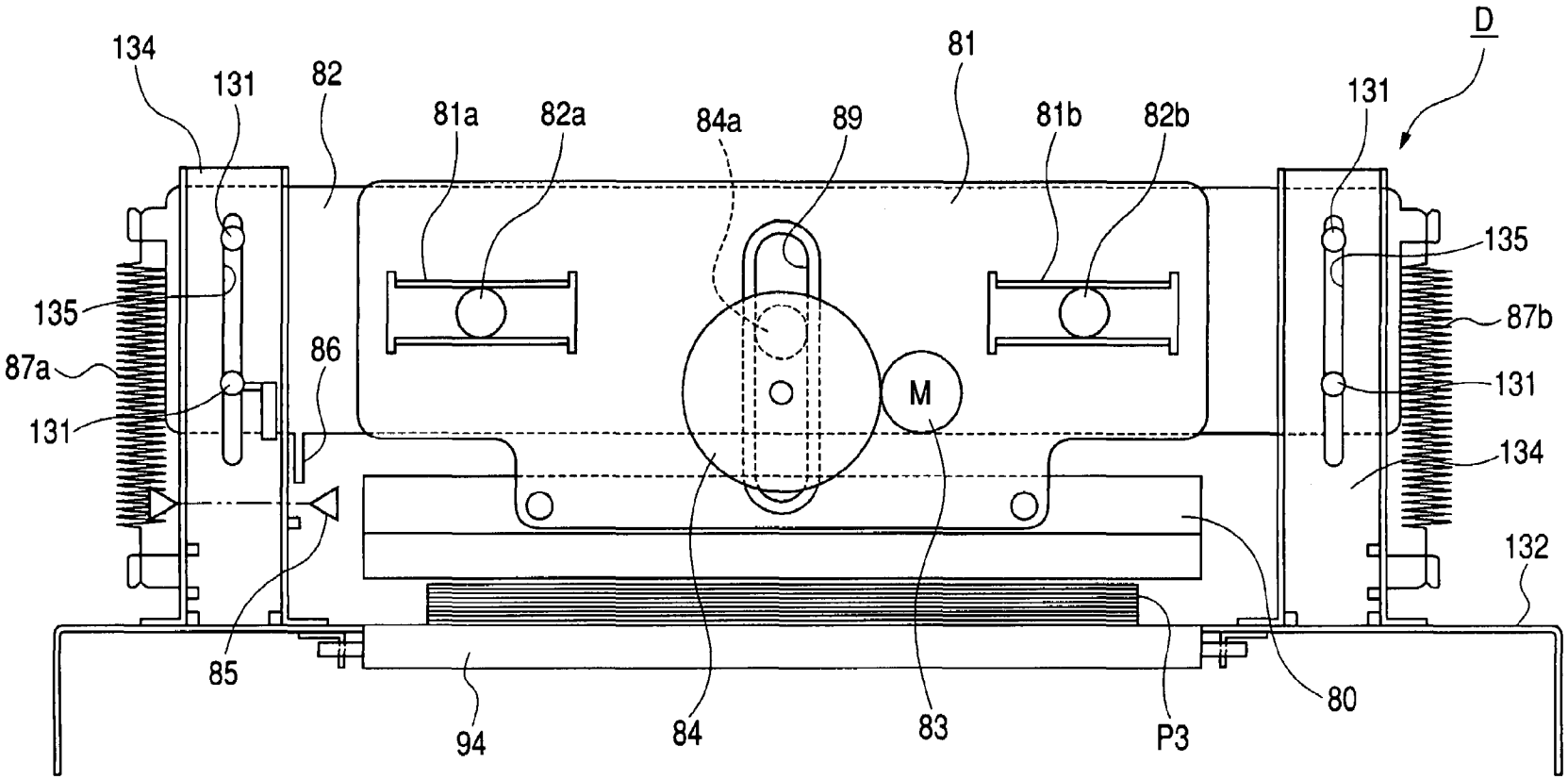
FIG. 10 is a side view of a trimmer unit.

The trimmer unit D shown in FIG. 10 is equipped, for example, with a cutting blade 80, which is an edged tool for cutting the bound sheet stack P3. The cutting blade 80 is formed as a plate, and only one side of which is sloped. The longitudinal length of the plate-like cutting blade 80 is larger than the maximum size of the sheet to be cut, and is long enough to be constantly placed on the bound sheet stack P3 for further longitudinal movement.

A longitudinal movement member 81 has the cutting blade 80, and is supported on a vertical movement member 82 by rollers 82*a* and 82*b*. The longitudinal movement member 81 is adapted to move in the longitudinal direction thereof and parallel to the cut surface of the bound sheet stack P3 by being guided by the rollers 82*a* and 82*b* provided on the vertical movement member 82 and abutment portions 81*a* and 81*b* formed in the longitudinal movement member 81 itself. Further, when a horizontal motor 83 rotates, a rotation cam 84 rotates, and a protrusion 84*a* formed on the rotation cam 84 is engaged with a rotation receiver 89 in the form of an elongated hole formed in the longitudinal movement member 81 itself, whereby the rotating movement of the horizontal motor 83 is converted to a linear reciprocating motion to thereby effect parallel movement in the longitudinal direction of the longitudinal movement member 81. Velocity adjustment for the reciprocating motion can be freely effected by providing the horizontal motor 83 with an encoder.

The movement of the cutting blade 80 in the thickness direction of the bound sheet stack P3 is effected by the vertical movement member 82. The vertical movement member 82 is guided by guide shafts 131 protruding therefrom and guide grooves 135 formed in columns 134 provided on a base 132, and moves along the columns 134, moving toward and away from the bound sheet stack P3. The vertical movement member 82 is provided with the rollers 82*a* and 82*b* supporting the longitudinal movement member 81, so that, when the vertical movement member 82 itself moves vertically, the longitudinal movement member 81 also moves vertically, and the cutting blade 80 also moves vertically. Further, in order to impart load (cutting force) to the cutting blade 80, the longitudinal movement member 81 is constantly pulled toward the bound sheet stack P3 by tension springs 87*a* and 87*b* through the vertical movement member 82.

Figure 11B:
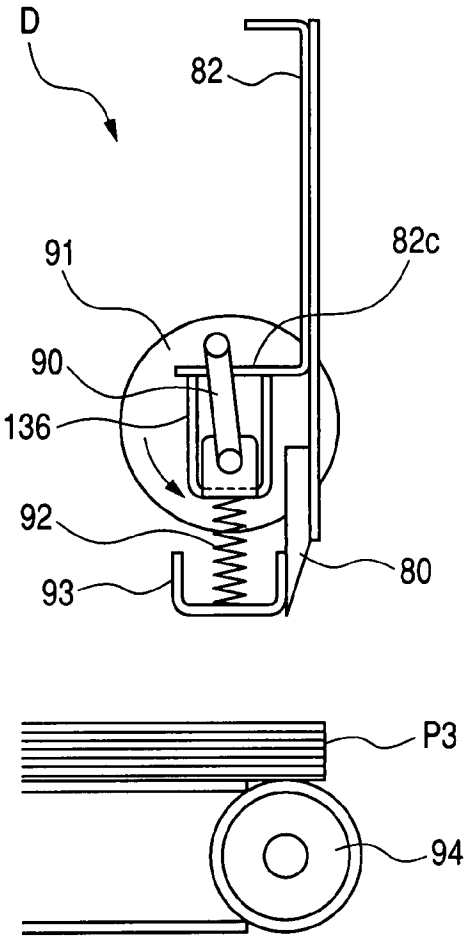
Figure 11A:
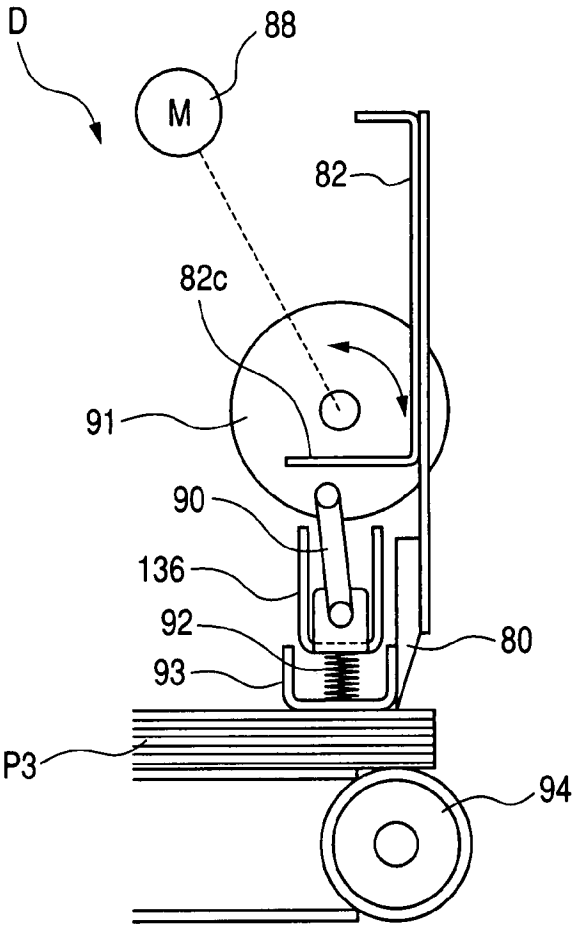

As shown in FIG. 11A, when a cam 91 rotates through rotation of a vertical motor 88, and a link 90 moves to a position near a lower supporting point, a sheet presser 93 comes into contact with the bound sheet stack P3, and by a further push-down force of the link 90 exerted against the resilient force of a sheet presser spring 92, the bound sheet stack P3 is pressed against a mat 94. While the link 90 moves to the lower supporting point, a mounting member 136 of the link 90 is separated from an abutment portion 82*c* of the vertical movement member 82, and the cutting blade 80 pressurizes the bound sheet stack P3 by the tension springs 87*a* and 87*b* through the vertical movement member 82.

Thus, as shown in FIG. 11B, the mechanism for operating the sheet presser 93 and the cutting blade 80 also functions as follows: when the cam 91 rotates, and the link 90 moves to the upper supporting point to cancel the pressurization of the bound sheet stack P3 effected by the sheet presser 93, the mounting member 136 of the link 90 abuts the abutment portion 82*c* of the vertical movement member 82, causing the cutting blade 80 to move upwardly in the thickness direction of the bound sheet stack P3 through the vertical movement member 82. Due to these functions, the cutting blade 80 can reciprocate in the thickness direction of the bound sheet stack.

Further, as shown in FIG. 10, the abutment portion 82*c* of the vertical movement member 82 is equipped with a blade position sensor flag 86. Further, one of the columns 134 is provided with a blade position sensor 85 for detecting the blade position sensor flag 86. The cutting of the bound sheet stack P3 by the cutting blade 80 is conducted until the blade position sensor 85 detects the blade position sensor flag 86.

Under the bound sheet stack P3, there is provided, for example, the mat 94 as the cutting blade 80 receiving means for the purpose of preventing damage of the cutting blade 80. The mat 94 of this embodiment is formed as a roller. The mat 94 is adapted to rotate in the direction indicated by the arrows in FIG. 12. Due to this configuration of the mat 94, it is possible to drop, through rotation, cut sheet dust P4 after the cutting into, for example, a dust box 97 as a dust storing means. From the viewpoint of preventing damage of the cutting blade 80, it is desirable for the mat 94 to be formed of a soft material, such as rubber, urethane, or molding.

(Operation of the Trimmer Unit)

The bound sheet stack P3 shown in FIG. 8A is conveyed to the trimmer unit D from the rotation stage 60 by the gripper unit 70. As shown in FIG. 10, the trimmer unit D causes the vertical motor 88 to start, and rotates the cam 91 until the link 90 reaches the lower supporting point. The link 90 brings the sheet presser 93 into contact with the bound sheet stack P3 through the sheet presser spring 92. The sheet presser spring 92 is compressed and presses the bound sheet stack P3 against the mat 94 with the sheet presser 93.

At this time, the link 90 operates with the sheet presser 93, with the result that the mounting member 136 moves away from the abutment portion 82*c* of the vertical movement member 82. Accordingly, the vertical movement member 82 is pulled by the tension springs 87*a* and 87*b* to descend following the mounting member 136. As a result of the descent of the mounting member 136, the cutting blade 80 descends, and comes into contact with the bound sheet stack P3.

After the cutting blade 80 comes into contact with the bound sheet stack P3, the horizontal motor 83 shown in FIG. 10 is started. The rotating motion of the horizontal motor 83 is converted to a reciprocating motion by the rotation cam 84, the protrusion 84*a*, and the rotation receiver 89. Thus, the longitudinal movement member 81 vertically reciprocates integrally with the cutting blade 80 in the thickness direction of the bound sheet stack. That is, the cutting blade 80 reciprocates horizontally as seen in FIG. 10. By the reciprocating movement, the cutting of the bound sheet stack P3 is started. The cutting blade 80 is pulled by the tension springs 87*a* and 87*b*, and moves in the thickness direction of the bound sheet stack P3 while cutting the bound sheet stack P3. The cutting of the bound sheet stack P3 through the reciprocating movement of the cutting blade 80 is conducted until the blade position sensor flag 86 is detected by the blade position sensor 85.

Figure 12:
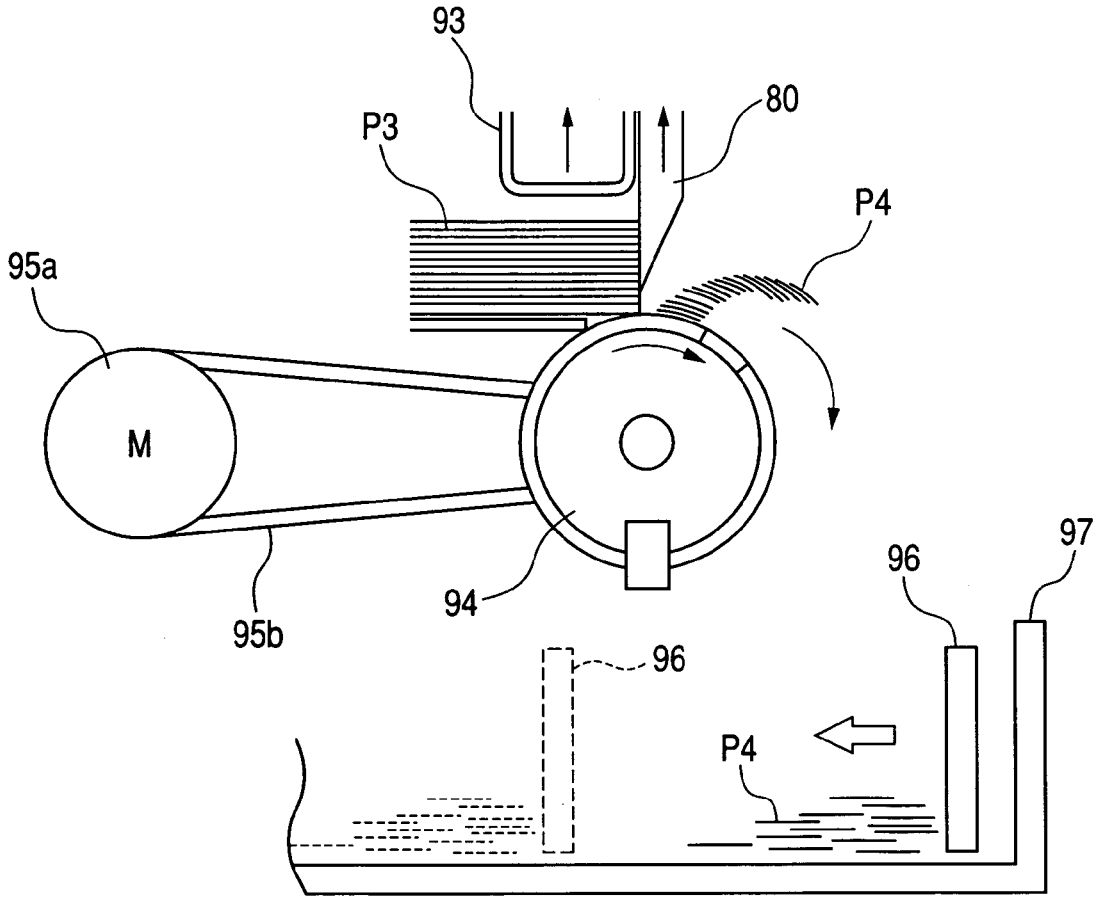
FIG. 12 is a diagram for illustrating the operation of dropping cut sheet dust in front of a pusher through rotation of a mat and discharging it into a dust box.

After the completion of the cutting of the bound sheet stack P3, the vertical motor 88 is rotated again to rotate the cam 91 until the link 90 reaches the upper supporting point, thereby moving the sheet presser 93 away from the bound sheet stack, and at the same time, moving the cutting blade 80 away from the mat 94. The cut sheet dust P4 is partly dropped into the dust box 97 as shown in FIG. 12, but is partly allowed to remain on the mat 94. In view of this, the mat 94 is rotated in the direction indicated by the arrows in FIG. 12 by a mat rotating motor 95*a* through a mat drive belt 95*b*. Then, the cut sheet dust P4 falls in front of a pusher 96 in the dust box 97 without remaining on the mat 94.

Thereafter, the cut sheet dust P4 is pushed toward the downstream side in the dust box 97 by the pusher 96. After the dust disposal rotational operation of the mat 94, the bound sheet stack P3 is rotated again by 90 degrees as described above, and the end portions of the three sides other than the glued portion are cut. Finally, the bound sheet stack P3, cut in the end portions of the three sides, is discharged onto the stacking tray E.

The operation procedures for controlling the position at which the bound sheet stack is cut by the trimmer unit D constructed as above of this embodiment will be described with reference to FIGS. 8A through 8C, 9, 13, 14, and 15. The CPU 200 performs two kinds of cutting processing described below based on the length of the shorter sides of the bound sheet stack P3.

Figure 13:
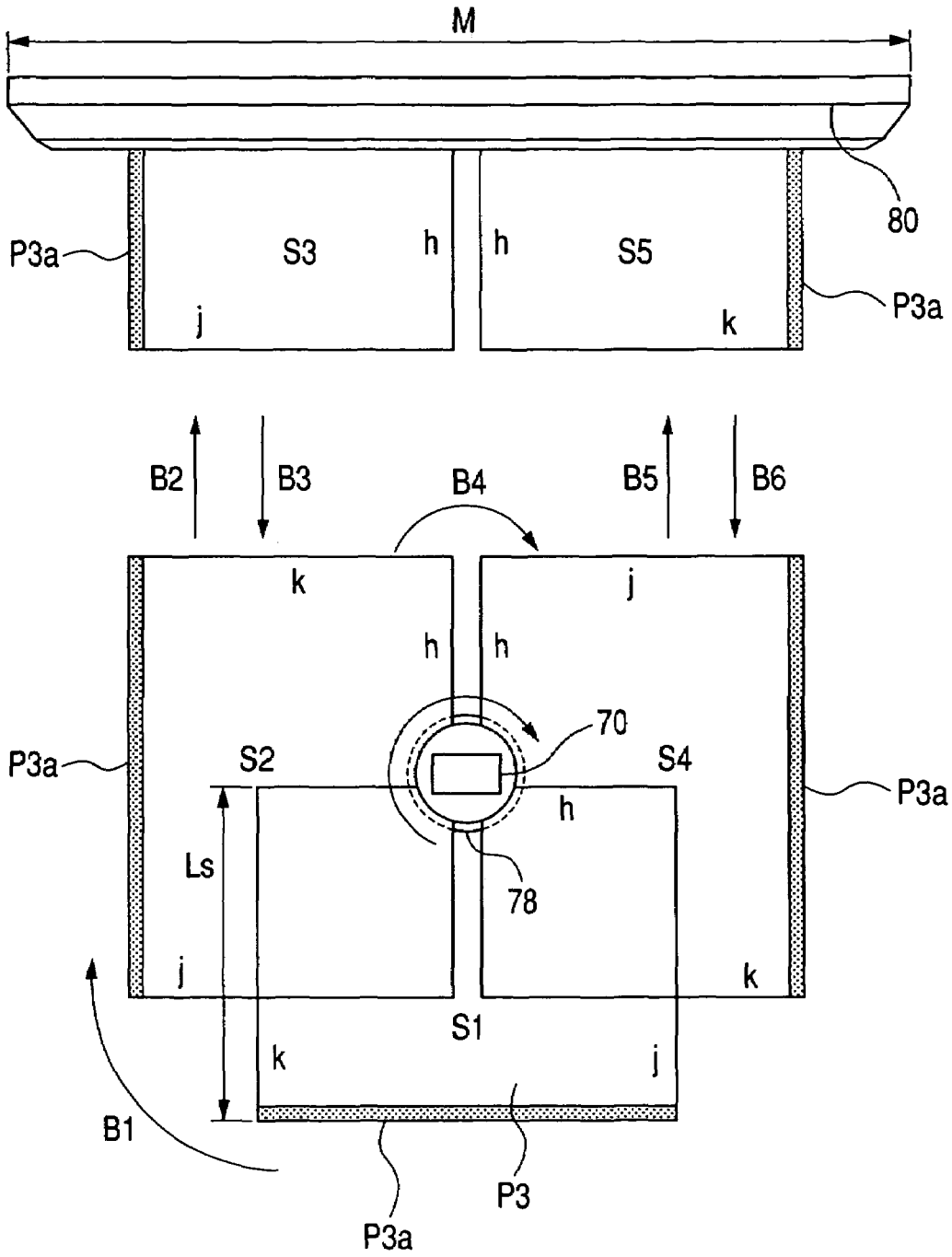
FIG. 13 is a plan view for illustrating a cutting order in which a bound sheet stack whose shorter side has a length not more than half of the length of the cutting blade is cut by the rotation stage and the trimmer unit.

FIG. 13 is a plan view for illustrating the procedures by which the bound sheet stack is cut by the rotation stage 60 (see FIGS. 8A through 8C) and the trimmer unit D. Symbols S1 through S5 indicate positions of the same bound sheet stack. Arrows B1 through B6 indicate the moving and rotating directions of the bound sheet stack. Symbol P3*a* indicates the glued end portion of the bound sheet stack.

Symbol M indicates the length of the cutting blade 80, and symbol Ls indicates the length of the shorter sides of the bound sheet stack P3. The CPU 200 causes the gripper unit 70 to operate in the trimmer unit D, and the bound sheet stack P3 on the rotation guide gear 78 (see also FIGS. 8A through 8C) is pressed against the rotation guide gear 78 by the holding member 145 of the gripper unit 70 to rotate the rotation guide gear 78, thus causing the end portion to be cut of the bound sheet stack P3 to be opposed to the cutting blade 80. Then, the bound sheet stack P3 is conveyed to the cutting blade 80 to perform the cutting of the end portion. The CPU 200 cuts the end portions of the three sides of the bound sheet stack by the procedures described above. For example, the longer sides of the bound sheet stack P3 will be referred to as h, and the shorter sides thereof as k and j. After the end portion as one longer side h of the bound sheet stack is cut, the orientation of the bound sheet stack P3 is changed by a method described below, and the end portions as the two shorter sides k and j are cut.

In executing the cutting processing control of this embodiment of the present invention, the CPU 200 performs comparison with the length M of the cutting blade M based on the size data of the bound sheet stack P3 previously stored in the RAM 202. Next, to be described will be the cutting processing in the case in which it is determined by the CPU 200 that the length Ls of the shorter sides k and j of the bound sheet stack P3 shown in FIG. 13 is not larger than half of the length M of the cutting blade 80, that is, not larger than (½)M. As to the cutting processing in the case in which the length Ls of the shorter sides k and j exceeds (½)M, it will be described below with reference to FIG. 14.

First, although not shown, the CPU 200 causes the gripper unit 70 to operate to pressurize the portion of the bound sheet stack P3 near the center thereof by the gripper unit 70, and moves the bound sheet stack P3 to the cutting blade 80, thus cutting the end portion h of the bound sheet stack P3 by the cutting blade 80. Thereafter, the bound sheet stack P3 is returned to the position indicated by symbol S1, and the portion of the bound sheet stack P3 to be pressurized by the gripper unit 70 is changed to the end portion h.

The CPU 200 operates the rotation motor 76, and rotates the bound sheet stack P3 by 90 degrees by the rotation guide gear 78 to rotate it to the position indicated by symbol S1 to the position indicated by symbol S2 (B1). Then, the bound sheet stack P3 is linearly moved to the position indicated by symbol S3 by the gripper unit 70 (B2), and the end portion as the shorter side k of the bound sheet stack P3 is cut by using the left half of the cutting blade 80. After cutting the end portion as the shorter side k of the bound sheet stack P3 using by using the left half of the cutting blade 80, the CPU 200 restores the bound sheet stack P3 to the position indicated by symbol S2 by the gripper unit 70 (B3).

Next, the CPU 200 operates the rotation motor 76, and rotates the bound sheet stack P3 by 180 degrees by the rotation guide gear 78, causing it to rotate from the position indicated by symbol S3 to the position indicated by symbol S4 (B4). Then, the bound sheet stack P3 is linearly moved from the position indicated by symbol S4 by the gripper unit 70 (B5), and the end portion as the shorter side j of the bound sheet stack P3 is cut by using the right half of the cutting blade 80. After cutting the end portion as the shorter side j of the bound sheet stack P3 by using the right half of the cutting blade 80, the CPU 200 returns the bound sheet stack P3 to the position indicated by symbol S4 by the gripper unit 70 (B6), and rotates it to the position indicated by symbol S1 to thereby complete the cutting of the end portions of the three sides of the bound sheet stack P3.

In this way, when the length of the shorter sides of the bound sheet stack P3 is not larger than half of the length M of the cutting blade 80 ((½)M), the trimmer unit D of this embodiment cuts the end portion of one side of the bound sheet stack P3 using by the left half of the cutting blade 80, and cuts the end portions of the other side by using the right half of the cutting blade 80, whereby it is possible to uniformly use the cutting blade 80 over its entire length, thereby preventing partial wear of the cutting blade 80 and making it possible to use the cutting blade 80 for a longer period of time than in the prior art.

Next, the cutting of the bound sheet stack when the length Ls of the shorter sides of the bound sheet stack P3 exceeds half of the length M of the cutting blade 80 ((½)M), that is, ((½)M<Ls), will be described with reference to FIG. 14. The symbols used in FIG. 14 indicate the same things as those in FIG. 13.

First, although not shown, the CPU 200 operates the gripper unit 70 to pressurize the portion of the bound sheet stack P3 near the center thereof, and moves the bound sheet stack P3 to the cutting blade 80, thus cutting the end portion h of the bound sheet stack P3 by the cutting blade 80.

Thereafter, the CPU 200 restores the bound sheet stack P3 to the position indicated by symbol S10, and changes the position where the bound sheet stack P3 is pressurized by the gripper unit 70 to a position spaced apart from the glued end portion P3*a* of the bound sheet stack P3 by the distance (½)M. Then, the CPU 200 operates the rotation motor 76, and rotates the rotation guide gear by 90 degrees, moving the bound sheet stack P3 from the position indicated by symbol S10 to the position indicated by symbol S20 (B10). At this time, at the position indicated by symbol S20, the outer longer side (which, in the drawing, is the glued end portion P3*a*) is in the same straight line as the left-hand end of the cutting blade 80. Thereafter, the CPU 200 performs cutting processing in the same manner as that of the cutting processing shown in FIG. 13 described above.

That is, the CPU 200 linearly moves the bound sheet stack P3 to the position indicated by symbol S30 by the gripper unit 70 (B11), and cuts the end portion as the shorter side k of the bound sheet stack P3. Thereafter, the CPU returns the bound sheet stack P3 to the position indicated by symbol S20 (B12), where the CPU 200 rotates the bound sheet stack P3 by 180 degrees to move it to the position indicated by symbol S40. Next, the CPU 200 linearly moves the bound sheet stack P3 to the position indicated by symbol S50 by the gripper unit 70 (B14), and cuts the end portion as the shorter side j of the bound sheet stack P3. Thereafter, the CPU 200 returns the bound sheet stack P3 to the position indicated by symbol S40 (B15), and rotates it to the position indicated by symbol S10 to complete the cutting of the end portions of the three sides of the bound sheet stack P3.

In this way, when ((½)M)<Ls, the cutting of the two shorter side end surfaces is effected in a positioning such that the longer side of the bound sheet stack P3 is aligned with an end of the cutting blade 80 in the drawing, whereby it is possible to effect the cutting processing in two cutting. operations, using the cutting blade 80 over its entire length, that is, from end to end. Thus, while the central portion of the cutting blade 80 is worn to a somewhat by a degree larger than that of the end portions thereof, it is possible to use the cutting blade 80 substantially uniformly over its entire length, thereby preventing partial wear of the cutting blade 80 and making it possible to use the cutting blade 80 for a longer period of time than in the prior art.

As described above, two kinds of cutting processing are conducted based on the size data of the bound sheet stack P3 previously stored in the RAM 202: when ((½)M≧Ls), the cutting processing as described with reference to FIG. 13 is conducted in which the bound sheet stack P3 is rotated around its end as an axis and transferred; when ((½)M<Ls), a cutting processing is conducted in which the bound sheet stack P3 is rotated around the position spaced apart from the glued end portion P3*a* by the distance (½)M. The CPU 200 compares the value of the length Ls of the shorter sides of the bound sheet stack with the value of half of the length M of the cutting blade, (½)M, and performs one of the two kinds of cutting processing based on the comparison result. Regarding the size data, size data designated at the operating portion of the main body is received by a communication device 209, and stored in the RAM 202.

While in the above embodiment the end portion h of the bound sheet stack is pressurized by the gripper unit 70, and rotated clockwise before transferring it, the portion to be pressurized may also be the end surface on the glued portion side, and the rotation may also be effected counterclockwise.

Figure 14:
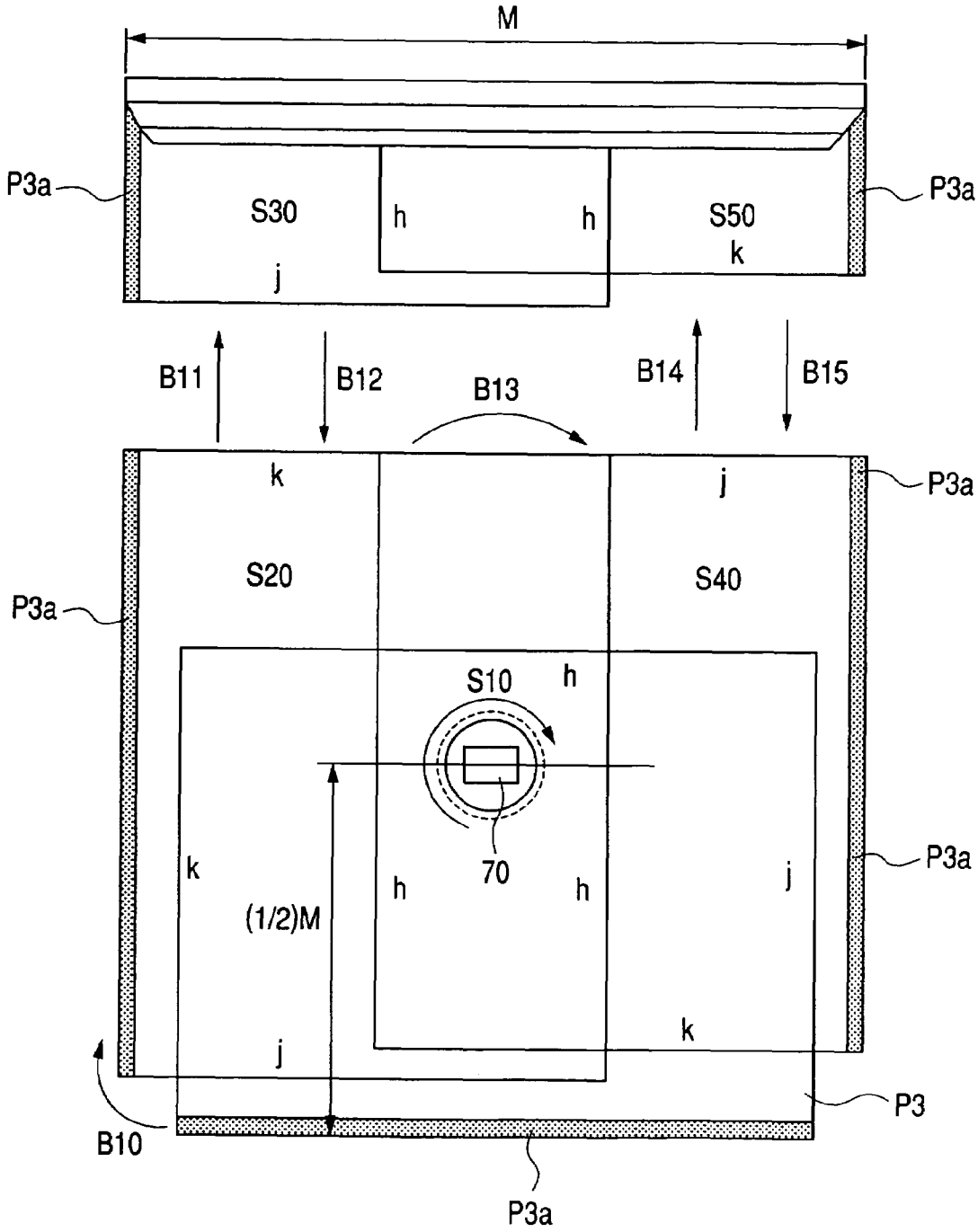
FIG. 14 is a plan view for illustrating a cutting order in which a bound sheet stack whose shorter side has a length more than half of the length of the cutting blade is cut by the rotation stage and the trimmer unit.

While the rotation of the bound sheet stack P3 is effected at the position indicated by symbol S1 in FIG. 13 or the position indicated by symbol S10 in FIG. 14, the rotation may be effected at any position as long as rotation is possible through pressing the bound sheet stack P3 on the rotation stage 60.

While this embodiment adopts the press-and-cut system in which the cutting blade 80 is vertically moved up to the sheet presser 93, it is also possible to adopt a guillotine system in which a vertically movable upper cutter and a stationary lower cutter are used, or a slide system in which the cutting blade 80 horizontally reciprocates.

In this embodiment, the axis around which the bound sheet P3 is rotated is changed in order to change the cutting position based on the size of the bound sheet stack P3. Apart from this, a method is available in which there is simply provided a driving motor that moves the bound sheet stack P3 parallel to the cutting blade 80, making it possible to move the bound sheet stack P3 in a direction perpendicular to and in a direction parallel to the cutting blade 80 and effecting the shift of the cutting position simply by conveyance through motor drive.

In the sheet cutting apparatus of this embodiment, the sheet to be cut is rotated by a transport means, so that it is possible to uniformly use the cutting blade, changing the portion of the cutting blade to be used, thereby making it possible to use the cutting blade for a long period of time.

Further, in the sheet cutting apparatus of this embodiment, the cutting blade can be used for a long period of time, so that the number of times for replacing the cutting blade is reduced, thereby enhancing the operating efficiency (availability ratio) of the apparatus.

In the sheet cutting apparatus of this embodiment, based on the size of the sheet to be cut, a transport means selectively holds the portion of the sheet to be cut which is a central position of the sheet to be cut with respect to a direction crossing the conveying direction of the sheet to be cut and which is an arbitrary position along the conveying direction of the sheet to be cut, and the sheet to be cut is rotated around the held portion to cause an end portion of the sheet to be cut to be opposed to the cutting blade, so that it is possible to use the portions of the cutting blade on both sides with respect to the central position substantially uniformly.

The sheet aftertreatment apparatus of this embodiment is equipped with a sheet cutting apparatus in which the number of times for replacing the cutting blade is reduced, thereby making it possible to achieve an improvement in terms of operating efficiency (availability ratio).

The image forming apparatus of this embodiment is equipped with a sheet aftertreatment apparatus of high operating efficiency (availability ratio), so that it is possible to achieve an improvement in terms of productivity in image formation.

While the invention has been described with reference to the structures disclosed herein, it is not confined to the details set forth and this application is intended to cover such modifications or changes as may come within the purpose of the improvements or the scope of the following claims.

What is claimed is:

1. A sheet cutting apparatus comprising:

a cutting blade which cuts a sheet to be cut, the sheet to be cut including a sheet or a sheet stack;

transport means for holding and rotating the sheet to be cut to cause an end portion of the sheet to be cut to be opposed to the cutting blade and transporting the sheet to be cut to a position in which the end portion is cut by the cutting blade; and selecting means for selecting a central position of the sheet to be cut with respect to a direction intersecting with a conveying direction in which the sheet to be cut is conveyed and an arbitrary position of the sheet to be cut along the conveying direction in accordance with a size of the sheet to be cut, wherein the transport means holds a portion of the sheet to be cut in a selected central position and in a selected arbitrary position of the sheet to be cut.

2. A sheet aftertreatment apparatus comprising:

alignment means for aligning at least one side as an end portion of a sheet stack; and a sheet cutting apparatus as recited in claim 1 for cutting the sheet stack aligned by the alignment means.

3. A sheet aftertreatment apparatus comprising:

a sheet cutting apparatus as recited in claim 1; and supply means for supplying the sheet to be cut to the transport means, with a central position of the sheet to be cut with respect to a direction intersecting with a supplying direction of the sheet to be cut being matched with the central position of the sheet to be cut with respect to the direction intersecting with the conveying direction of the sheet to be cut in the transport means of the sheet cutting apparatus.

4. A sheet aftertreatment apparatus comprising:

a sheet cutting apparatus as recited in claim 1; and supply means for supplying the sheet to be cut to the transport means, with a central position of the sheet to be cut with respect to a direction intersecting with a supplying direction of the sheet to be cut being matched with the central position of the sheet to be cut with respect to the direction intersecting with the conveying direction of the sheet to be cut in the transport means of the sheet cutting apparatus.

5. An image forming apparatus comprising:

image forming means for forming an image on a sheet; and a sheet aftertreatment apparatus as recited in any one of claims 2, 3, or 4 for cutting the sheet to be cut on which the image has been formed by the image forming means.

* * * * *

UNITED STATES PATENT AND TRADEMARK OFFICE

CERTIFICATE OF CORRECTION

PATENT NO. : 7,413,360 B2
APPLICATION NO. : 11/083933
DATED : August 19, 2008
INVENTOR(S) : Toshiki Kikuchi It is certified that error appears in the above-identified patent and that said Letters Patent is hereby corrected as shown below:

ON THE TITLE PAGE:

At Item (56), Foreign Patent Documents, "2003071780 A" should read --2003-071780--.

COLUMN 1:

Line 17, "etc." should read --etc.,--.
Line 25, "etc." should read --etc.,--.

COLUMN 3:

Line 52, "and" should read --and a--.

COLUMN 5:

Line 1, "two-side" should read --two-sided--.
Line 3, "switch back" should read --switch-back--.

COLUMN 6:

Line 20, "etc." should read --etc.,--.
Line 21, "etc." should read --etc.,--.

COLUMN 7:

Line 41, "since" should read --elapses from--.

COLUMN 11:

Line 9, "indicated" should read --indicated by--.

COLUMN 12:

Line 47, "etc." should read --etc.,--.

COLUMN 15:

Line 49, "using" should be deleted.

UNITED STATES PATENT AND TRADEMARK OFFICE

CERTIFICATE OF CORRECTION

PATENT NO. : 7,413,360 B2
APPLICATION NO. : 11/083933
DATED : August 19, 2008
INVENTOR(S) : Toshiki Kikuchi It is certified that error appears in the above-identified patent and that said Letters Patent is hereby corrected as shown below:

COLUMN 16:

Line 5, "using by" should read --by using--.

Line 60, "a somewhat by a degree larger" should read --a somewhat larger degree--.

Signed and Sealed this

Tenth Day of March, 2009

JOHN DOLL
*Acting Director of the United States Patent and Trademark Office*